US011414932B2

(12) United States Patent
Parkin

(10) Patent No.: US 11,414,932 B2
(45) Date of Patent: Aug. 16, 2022

(54) EQUIPMENT STRING COMMUNICATION AND STEERING

(71) Applicant: Schlumberger Technology Corporation, Sugar Land, TX (US)

(72) Inventor: Edward George Parkin, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 19 days.

(21) Appl. No.: 17/151,809

(22) Filed: Jan. 19, 2021

(65) Prior Publication Data

US 2021/0140242 A1 May 13, 2021

Related U.S. Application Data

(63) Continuation of application No. 16/088,890, filed as application No. PCT/US2017/024222 on Mar. 27, 2017, now Pat. No. 10,907,412.

(60) Provisional application No. 62/316,401, filed on Mar. 31, 2016, provisional application No. 62/316,404, filed on Mar. 31, 2016, provisional application No. 62/316,409, filed on Mar. 31, 2016.

(51) Int. Cl.

| | |
|---|---|
| ***E21B 34/06*** | (2006.01) |
| ***E21B 47/00*** | (2012.01) |
| ***E21B 47/024*** | (2006.01) |
| ***E21B 7/06*** | (2006.01) |

(52) U.S. Cl.

CPC ..... *E21B 7/062* (2013.01); *E21B 34/066* (2013.01); *E21B 47/00* (2013.01); *E21B 47/024* (2013.01)

(58) Field of Classification Search

CPC ..... E21B 34/066; E21B 47/00; E21B 47/024; E21B 7/06; E21B 7/062

See application file for complete search history.

(56) References Cited

U.S. PATENT DOCUMENTS 5,054,565 A 10/1991 Kinnan
5,553,678 A 9/1996 Barr et al.
(Continued)

FOREIGN PATENT DOCUMENTS

WO WO-2017172563 A1 * 10/2017 ..... E21B 34/066

OTHER PUBLICATIONS

International Search Report and Written Opinion issued in International Patent Application No. PCT/US2017/024222 dated Jun. 5, 2017, 20 pages.

(Continued)

*Primary Examiner* — Daniel P Stephenson

(57) ABSTRACT

Aspects of the disclosure relate to a system including an implement (e.g., a steering tool, a drill bit) tetherable to an equipment string (e.g., a drill string), where the implement includes a steering mechanism to steer the equipment string with respect to a wall of a tubular passage (e.g., a borehole). The system can also include a bearing housing for the equipment string (e.g., connectable to a drill pipe of the drill string), where the bearing housing is rotationally coupled with the implement and rotated. The system can further include an actuation mechanism coupleable between the bearing housing and the steering mechanism to actuate the steering mechanism based upon a rotational orientation of the bearing housing with respect to the steering mechanism.

20 Claims, 20 Drawing Sheets

(56) References Cited

U.S. PATENT DOCUMENTS 5,617,926 A 4/1997 Eddison et al.
5,685,379 A 11/1997 Barr et al.
5,695,015 A 12/1997 Barr et al.
5,706,905 A 1/1998 Barr
5,967,247 A 10/1999 Pessier
6,089,332 A 7/2000 Barr et al.
6,092,610 A 7/2000 Kosmala et al.
6,109,372 A 8/2000 Dorel et al.
6,116,354 A 9/2000 Buytaert
6,158,529 A 12/2000 Dorel
6,199,633 B1 3/2001 Longbottom
6,234,259 B1 5/2001 Kuckes et al.
6,279,669 B1 8/2001 Swietlik et al.
6,427,783 B2 8/2002 Krueger et al.
6,427,792 B1 8/2002 Roberts et al.
6,438,495 B1 8/2002 Chau et al.
6,484,825 B2 11/2002 Watson et al.
6,523,623 B1 2/2003 Schuh
6,550,548 B2 4/2003 Taylor
6,595,303 B2 7/2003 Noe et al.
6,695,056 B2 2/2004 Haugen et al.
6,705,413 B1 3/2004 Tessari
6,715,570 B1 4/2004 Downton et al.
6,742,604 B2 6/2004 Brazil et al.
6,814,162 B2 11/2004 Moran et al.
6,845,826 B1 1/2005 Feld et al.
6,857,484 B1 2/2005 Helms et al.
6,892,830 B2 5/2005 Noe et al.
6,920,085 B2 7/2005 Finke et al.
6,942,044 B2 9/2005 Moore et al.
6,962,214 B2 11/2005 Hughes et al.
7,004,263 B2 2/2006 Moriarty et al.
7,025,130 B2 4/2006 Bailey et al.
7,066,271 B2 6/2006 Chen et al.
7,086,485 B2 8/2006 Moriarty et al.
7,136,795 B2 11/2006 Downton
7,168,507 B2 1/2007 Downton
7,168,510 B2 1/2007 Boyle et al.
7,188,685 B2 3/2007 Downton et al.
7,207,398 B2 4/2007 Runia et al.
7,213,643 B2 5/2007 Chen et al.
7,228,918 B2 6/2007 Evans et al.
7,243,739 B2 7/2007 Rankin, III
7,245,229 B2 7/2007 Baron et al.
7,267,175 B2 9/2007 Haugen et al.
7,267,184 B2 9/2007 Helms et al.
7,285,931 B2 10/2007 Ahmed
7,287,605 B2 10/2007 Van Steenwyk et al.
7,287,609 B2 10/2007 Runia et al.
7,306,056 B2 12/2007 Ballantyne et al.
7,306,058 B2 12/2007 Cargill et al.
7,316,277 B2 1/2008 Jeffryes
7,318,492 B2 1/2008 Watson et al.
7,334,649 B2 2/2008 Chen et al.
7,373,995 B2 5/2008 Hughes et al.
7,377,333 B1 5/2008 Sugiura
7,389,832 B2 6/2008 Hooper
7,413,034 B2 8/2008 Kirkhope et al.
7,426,967 B2 9/2008 Sugiura
7,467,673 B2 12/2008 Earles et al.
7,477,162 B2 1/2009 Clark
7,481,281 B2 1/2009 Schauf
7,513,318 B2 4/2009 Underwood et al.
7,549,467 B2 6/2009 McDonald et al.
7,556,105 B2 7/2009 Krueger
7,558,675 B2 7/2009 Sugiura
7,571,643 B2 8/2009 Sugiura
7,584,788 B2 9/2009 Baron et al.
7,621,343 B2 11/2009 Chen et al.
7,669,669 B2 3/2010 Downton et al.
7,681,663 B2 3/2010 Cobern
7,703,548 B2 4/2010 Clark
7,725,263 B2 5/2010 Sugiura
7,762,356 B2 7/2010 Turner et al.
7,810,585 B2 10/2010 Downton
7,818,128 B2 10/2010 Zhou et al.
7,832,503 B2 11/2010 Sand et al.
7,849,936 B2 12/2010 Hutton
7,866,415 B2 1/2011 Peters
7,897,915 B2 3/2011 Hall et al.
7,913,773 B2 3/2011 Li et al.
7,931,098 B2 4/2011 Aronstam et al.
7,942,213 B2 5/2011 Sihler
7,950,473 B2 5/2011 Sugiura
7,953,586 B2 5/2011 Chen et al.
7,975,780 B2 7/2011 Sihler et al.
7,980,328 B2 7/2011 Hallworth et al.
7,999,422 B2 8/2011 Dorel
8,011,446 B2 9/2011 Wylie et al.
8,011,448 B2 9/2011 Tulloch et al.
8,020,634 B2 9/2011 Utter et al.
8,031,081 B2 10/2011 Pisoni et al.
8,061,455 B2 11/2011 Beuershausen
8,069,931 B2 12/2011 Hooks et al.
8,104,548 B2 1/2012 Ma et al.
8,115,651 B2 2/2012 Camwell et al.
8,118,114 B2 2/2012 Sugiura
8,122,977 B2 2/2012 Dewey et al.
8,141,657 B2 3/2012 Hutton
8,146,679 B2 4/2012 Downton
8,157,002 B2 4/2012 Clarkson et al.
8,172,010 B2 5/2012 Strachan
8,176,999 B2 5/2012 Stroud et al.
8,179,278 B2 5/2012 Shakra et al.
8,196,678 B2 6/2012 Jeffryes
8,235,146 B2 8/2012 Haugvaldstad et al.
8,276,689 B2 10/2012 Giroux et al.
8,286,733 B2 10/2012 Tulloch et al.
8,302,703 B2 11/2012 Rolovic
8,333,254 B2 12/2012 Hall et al.
8,342,266 B2 1/2013 Hall et al.
8,376,067 B2 2/2013 Downton et al.
8,403,332 B2 3/2013 Noguchi et al.
8,408,333 B2 4/2013 Pai et al.
8,459,379 B2 6/2013 Sui et al.
8,462,012 B2 6/2013 Clark et al.
8,474,552 B2 7/2013 De Paula Neves et al.
8,497,685 B2 7/2013 Sugiura
8,522,897 B2 9/2013 Hall et al.
8,544,181 B2 10/2013 Detournay
8,544,553 B2 10/2013 Milkovisch et al.
8,550,186 B2 10/2013 Deolalikar et al.
8,570,045 B2 10/2013 Tchakarov et al.
8,590,636 B2 11/2013 Menger
8,590,638 B2 11/2013 Downton
8,606,552 B2 12/2013 Chen
8,614,273 B2 12/2013 Noguichi et al.
8,640,792 B2 2/2014 Underwood et al.
8,651,177 B2 2/2014 Vail, III et al.
8,672,056 B2 3/2014 Clark et al.
8,701,795 B2 4/2014 Menger et al.
8,708,064 B2 4/2014 Downton et al.
8,726,988 B2 5/2014 Pop et al.
8,739,868 B2 6/2014 Zeineddine
8,739,901 B2 6/2014 Cote
8,763,725 B2 7/2014 Downton
8,781,744 B2 7/2014 Ekseth et al.
8,783,382 B2 7/2014 Ignova et al.
8,791,396 B2 7/2014 Burns et al.
8,792,304 B2 7/2014 Sugiura
8,812,281 B2 8/2014 Tang et al.
8,827,006 B2 9/2014 Moriarty
8,844,620 B2 9/2014 Gregurek et al.
8,869,916 B2 10/2014 Clausen et al.
8,905,159 B2 12/2014 Downton
9,206,644 B2 12/2015 Clark et al.
10,066,448 B2 9/2018 Parkin et al.
2001/0042643 A1 11/2001 Krueger et al.
2002/0112894 A1 8/2002 Caraway
2003/0070841 A1 4/2003 Merecka et al.
2004/0020691 A1 2/2004 Krueger
2004/0050590 A1 3/2004 Pirovolou et al.
2004/0256162 A1 12/2004 Helms et al.
2005/0126826 A1 6/2005 Moriarty et al.

(56) References Cited

U.S. PATENT DOCUMENTS

2005/0133268 A1 6/2005 Moriarty
2005/0139393 A1 6/2005 Maurer et al.
2005/0150694 A1 7/2005 Schuh
2007/0018848 A1 1/2007 Bottos et al.
2007/0108981 A1 5/2007 Banning-Geertsma et al.
2008/0023229 A1 1/2008 Richards et al.
2008/0083567 A1 4/2008 Downton et al.
2008/0142268 A1 6/2008 Downton et al.
2009/0166089 A1 7/2009 Millet
2010/0071910 A1 3/2010 Ellson et al.
2010/0072708 A1 3/2010 Cargill
2010/0175923 A1 7/2010 Allan
2010/0224356 A1 9/2010 Moore
2010/0243242 A1 9/2010 Boney et al.
2010/0284247 A1 11/2010 Manning et al.
2010/0332175 A1 12/2010 Marsh et al.
2011/0036631 A1 2/2011 Prill et al.
2011/0083900 A1 4/2011 Lavrut
2011/0088890 A1 4/2011 Clark
2011/0139513 A1 6/2011 Downton
2011/0156357 A1 6/2011 Noguchi et al.
2011/0266063 A1 11/2011 Downton
2011/0280104 A1 11/2011 McClung, III
2011/0298462 A1 12/2011 Clark et al.
2011/0308858 A1 12/2011 Menger et al.
2012/0018225 A1 1/2012 Peter et al.
2012/0043133 A1 2/2012 Millet
2012/0046868 A1 2/2012 Tchakarov et al.
2012/0085583 A1 4/2012 Logan et al.
2012/0090827 A1 4/2012 Sugiura
2012/0186816 A1 7/2012 Dirksen et al.
2012/0199399 A1 8/2012 Henley et al.
2012/0205154 A1 8/2012 Lozinsky et al.
2012/0211280 A1 8/2012 Dewey et al.
2012/0228032 A1 9/2012 Dewey et al.
2012/0261193 A1 10/2012 Swadi et al.
2012/0298420 A1 11/2012 Seydoux et al.
2012/0299743 A1 11/2012 Price et al.
2012/0312600 A1 12/2012 Abbasi
2013/0014992 A1 1/2013 Sharp et al.
2013/0032399 A1 2/2013 Dirksen
2013/0038464 A1 2/2013 Alteirac et al.
2013/0043076 A1 2/2013 Larronde et al.
2013/0043874 A1 2/2013 Clark et al.
2013/0069655 A1 3/2013 Meelhinney et al.
2013/0075164 A1 3/2013 Hutton et al.
2013/0112483 A1 5/2013 Kibsgaard et al.
2013/0112484 A1 5/2013 Chen
2013/0118809 A1 5/2013 Veeningen
2013/0126239 A1 5/2013 Panchal et al.
2013/0126240 A1 5/2013 Johnston et al.
2013/0151158 A1 6/2013 Brooks et al.
2013/0186687 A1 7/2013 Snyder
2013/0199844 A1 8/2013 Bayliss et al.
2013/0222149 A1 8/2013 Li et al.
2013/0264120 A1 10/2013 Zhou
2013/0270009 A1 10/2013 Logan et al.
2013/0328442 A1 12/2013 Hay et al.
2013/0333946 A1 12/2013 Sugiura
2013/0333947 A1 12/2013 Hay
2013/0341095 A1 12/2013 Perrin et al.
2013/0341098 A1 12/2013 Perrin et al.
2014/0008125 A1 1/2014 Hay
2014/0008126 A1 1/2014 Normore et al.
2014/0014413 A1 1/2014 Niina et al.
2014/0027185 A1 1/2014 Menger et al.
2014/0034311 A1 2/2014 Lirette et al.
2014/0048285 A1 2/2014 Sihler
2014/0049401 A1 2/2014 Tang et al.
2014/0083777 A1 3/2014 Korchounov
2014/0097026 A1 4/2014 Clark et al.
2014/0102793 A1 4/2014 Hall et al.
2014/0102800 A1 4/2014 Lacour
2014/0110178 A1 4/2014 Savage et al.
2014/0131106 A1 5/2014 Coull et al.
2014/0138157 A1 5/2014 Heisig
2014/0190750 A1 7/2014 Samuel
2014/0196949 A1 7/2014 Hareland et al.
2014/0196953 A1 7/2014 Chitwood et al.
2014/0209389 A1 7/2014 Sugiura et al.
2014/0231136 A1 8/2014 Winslow
2014/0231141 A1 8/2014 Hay et al.
2014/0262273 A1 9/2014 Brown et al.
2014/0262507 A1 9/2014 Marson et al.
2014/0262514 A1 9/2014 Beylotte
2014/0262528 A1 9/2014 Desai et al.
2014/0265565 A1 9/2014 Cooley et al.
2014/0284110 A1 9/2014 Savage et al.
2014/0291024 A1 10/2014 Sugiura et al.
2014/0326509 A1 11/2014 Hay et al.
2015/0136490 A1 5/2015 Broussard, Jr.
2015/0337601 A1 11/2015 Niina et al.
2019/0100966 A1 4/2019 Parkin
2021/0140242 A1* 5/2021 Parkin ..... E21B 7/062

OTHER PUBLICATIONS

International Preliminary Report on Patentability issued in International Patent Application No. PCT/US2017/024222 dated Oct. 11, 2018, 16 pages.

* cited by examiner

EQUIPMENT STRING COMMUNICATION AND STEERING

CROSS-REFERENCE TO RELATED APPLICATIONS

This application is a continuation of U.S. patent application Ser. No. 16/088,890, filed Sep. 27, 2018, which is a National Stage Entry of International Patent Application No. PCT/US2017/024222, filed Mar. 27, 2017, which claims the benefit of, and priority to, U.S. Patent Application No. 62/316,401, filed on Mar. 31, 2016", to U.S. Patent Application No. 62/316,404 filed on Mar. 31, 2016, and to U.S. Patent Application No. 62/316,409, filed on Mar. 31, 2016. Each of the foregoing is incorporated herein by this reference in its entirety.

BACKGROUND

Oil wells are created by drilling a hole into the earth using a drilling rig that rotates a drill string (e.g., drill pipe) having a drill bit attached thereto. The drill bit, aided by the weight of pipes (e.g., drill collars) cuts into rock within the earth. Drilling fluid (e.g., mud) is pumped into the drill pipe and exits at the drill bit. The drilling fluid may be used to cool the bit, lift rock cuttings to the surface, at least partially prevent destabilization of the rock in the wellbore, and/or at least partially overcome the pressure of fluids inside the rock so that the fluids do not enter the wellbore.

SUMMARY

Aspects of the disclosure relate to a system including an implement (e.g., a steering tool, a drill bit) tetherable to an equipment string (e.g., a drill string), where the implement includes a steering mechanism to steer the equipment string with respect to a wall of a tubular passage (e.g., a borehole). The system can also include a bearing housing for the equipment string (e.g., connectable to a drill pipe of the drill string), where the bearing housing is rotationally coupled with the implement and rotated. The system can further include an actuation mechanism coupleable between the bearing housing and the steering mechanism to actuate the steering mechanism based upon a rotational orientation of the bearing housing with respect to the steering mechanism.

Other aspects of the disclosure relate to a method for steering an implement tethered to an equipment string. The method can include determining, at the implement, a rotational characteristic of a bearing housing of the equipment string with respect to a tubular passage based, at least in part, upon a first sensor value, and actuating a steering mechanism to steer the equipment string with respect to a wall of the tubular passage based upon the rotational characteristic of the bearing housing with respect to the tubular passage. In some embodiments, determining the rotational characteristic of the bearing housing with respect to the tubular passage can include determining, at the implement, a rotational characteristic of the implement with respect to the tubular passage based upon the first sensor value, determining, at the implement, a rotational characteristic of the implement with respect to the bearing housing based upon a second sensor value, and calculating, at the implement, the rotational characteristic of the bearing housing with respect to the tubular passage based upon the rotational characteristic of the implement with respect to the tubular passage and the rotational characteristic of the implement with respect to the bearing housing.

Also, aspects of the disclosure relate to a system for communicating with an implement tethered to an equipment string. The system can include a first sensor at the implement to determine a rotational characteristic of the implement with respect to a tubular passage, a second sensor at the implement to determine a rotational characteristic of the implement with respect to a bearing housing of the equipment string, and a processor to calculate a rotational characteristic of the bearing housing with respect to the tubular passage based upon the rotational characteristic of the implement with respect to the tubular passage and the rotational characteristic of the implement with respect to the bearing housing.

Further, aspects of the disclosure relate to a method for steering an implement tethered to an equipment string. The method can include determining, at the implement, a rotational characteristic of a bearing housing of the equipment string with respect to a tubular passage based, at least in part, upon a first sensor value. The method can also include determining, when the rotational characteristic of the bearing housing with respect to the tubular passage has a negligible rotational velocity, the equipment string is in a sliding mode, determining, when the rotational characteristic of the bearing housing with respect to the tubular passage has a net rotational velocity, the equipment string is in a rotating mode, and actuating a steering mechanism to steer the equipment string when the equipment string is in the sliding mode.

Also, aspects of the disclosure relate to a method of performing directional drilling. The method can include receiving an instruction to steer an equipment string, where the equipment string includes an implement tethered to the equipment string and a bearing housing rotationally coupled with the implement to support the implement and to be rotated, and where the implement includes a steering mechanism to steer the equipment string. The method can also include rotationally aligning an indicator on the bearing housing in a predetermined direction according to the instruction. In some embodiments, the method can further include rotating the implement relative to the bearing housing, and actuating the steering mechanism based upon an orientation of the indicator to steer the equipment string with respect to a wall of a tubular passage. In some embodiments, the instruction to steer the equipment string can be an instruction to steer the equipment string in a neutral direction, and the indicator is rotationally aligned by continuously rotating the bearing housing.

This summary is provided to introduce a selection of concepts that are further described below in the detailed description. This summary is not intended to identify key or essential features of the claimed subject matter, nor is it intended to be used as an aid in limiting the scope of the claimed subject matter.

FIGURES

Embodiments of Equipment String Communication and Steering are described with reference to the following figures. Same reference numbers may be used throughout the figures to reference like features and components.

DETAILED DESCRIPTION

Figure 1:
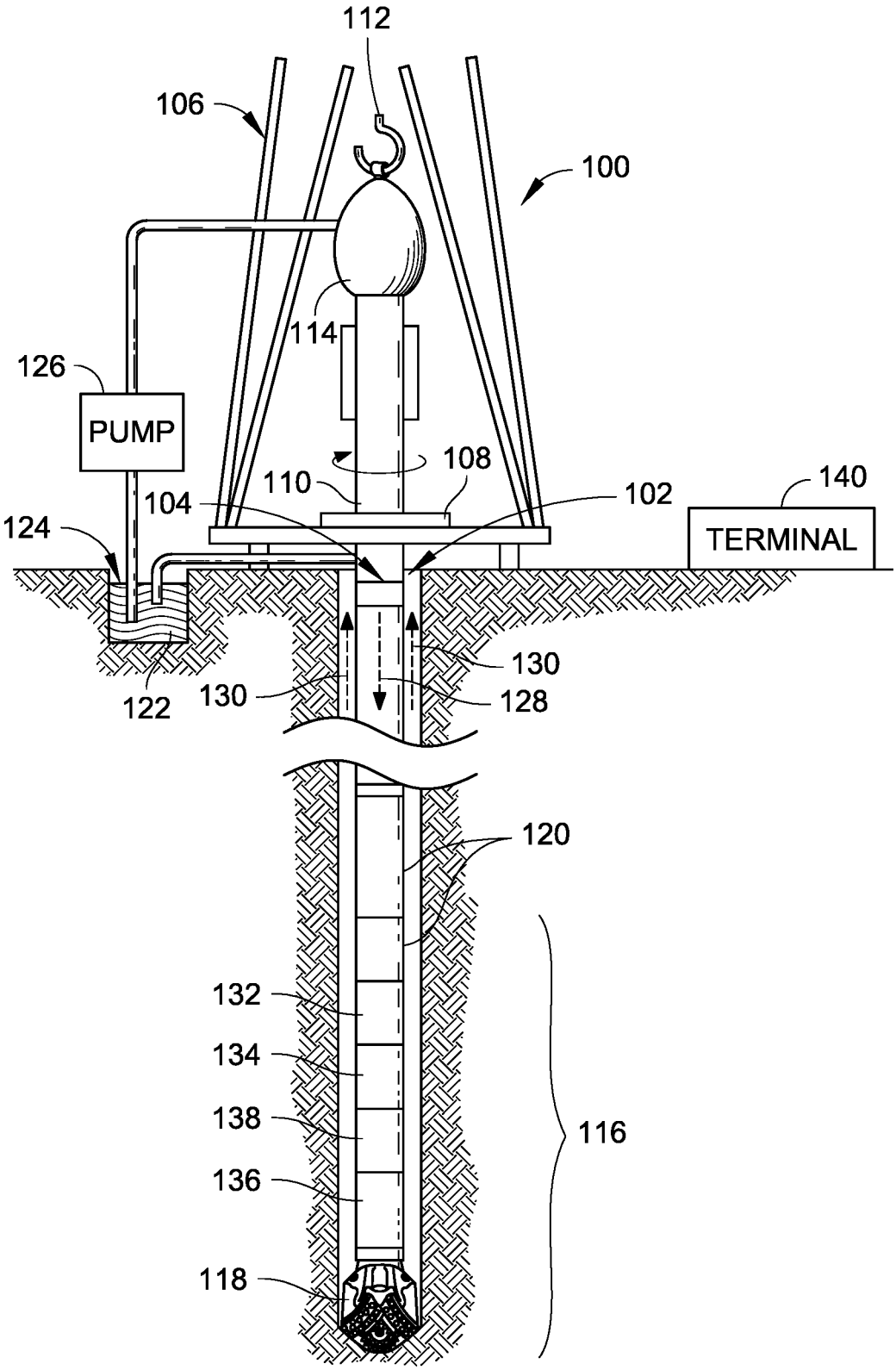
FIG. 1 illustrates an example system in which embodiments of Equipment String Communication and Steering can be implemented.

Referring generally to FIGS. 1 through 17, apparatus, systems, and techniques are described that can provide steering functionality for an equipment string, such as a drill string. As described herein, an implement (e.g., a tool or a sub, such as a rotary steerable system, a drill bit, etc.) can be tethered down hole at the end of the equipment string. For example, a rotary steerable system is tethered to a bearing housing. The implement includes one or more steering mechanisms (e.g., pads) that are extendable from the implement toward a wall of the passage to steer the equipment string (e.g., away from the wall). In some embodiments, the implement can be driven through the bearing housing. For example, the implement is connected to a driveshaft driven from above the tool, e.g., by a mud motor. In embodiments of the disclosure, one or more actuators of a steering mechanism is positioned in the driveshaft bit box, which can allow use of the full radial cross-section of the tool (excepting possibly a flow channel for drilling mud, and so on). As the driveshaft rotates, multiple actuators can be used to steer the end of the equipment string. Thus, the steering mechanisms can be operated at the speed of the tool (e.g., at bit speed).

The systems and apparatus described herein can be used instead of, or in addition to, for example, a bent motor housing. For instance, rather than using a motor housing with a bend (e.g., a three degree (3°) bent housing) where pumping of drilling mud is stopped while the drill string is turned, and then pumping is resumed while the rotational orientation of the motor housing is held fixed with respect to that of the drill string, the systems and apparatus described herein can facilitate continuous pumping to a mud motor, while the tool can be controlled like the mud motor, in a sliding mode, in a rotary mode, and so on. For example, the timing of valves opening and closing can be directly linked to the angle of the bearing housing with respect to the tool. In sliding mode, actuation can be in line with a toolface given by the motor housing (e.g., set by a measuring-while-drilling module), while in rotary mode, the actuation direction can be random (e.g., having no net direction) as the motor housing rotates (e.g., similar to a rotary steerable system "neutral mode"). The actuation can also be stopped completely while the tool rotates. Thus, instead of a rotary valve controlled by an electric motor or a control unit, one or more actuators can be linked to the bearing housing.

As described herein, the systems and apparatus of the present disclosure can provide improved hole quality (e.g., in comparison to a mud motor and bent motor housing configuration), e.g., for improved weight transfer, improved rate of penetration (ROP), and so on. Further, reduced bearing and power section loads can be facilitated, as well as a variety of surface rotation options for the drill string. In some embodiments, the systems and apparatus can be implemented simply (e.g., without electronics), and/or with minimal additional tool length, changes to motor design, pass-through diameter of the bit, and so on. Such equipment can also be less expensive (e.g., than a typical rotary steerable system), simpler to operate, and/or more reliable due to simpler construction, fewer parts, and so forth. It should also be noted that control of the systems and apparatus described herein may also be simplified. For example, toolface measurements (e.g., in a remote steerable system) and/or downlinks may not necessarily be required. In addition, electronic control circuitry may be relatively simple and/or may be eliminated.

As described herein, drilling applications are provided by way of example and are not meant to limit the present disclosure. In other embodiments, systems, techniques, and apparatus as described herein can be used with other down hole operations. Further, such systems, techniques, and apparatus can be used in other applications not necessarily related to down hole operations.

FIG. 1 depicts a wellsite system 100 in accordance with one or more embodiments of the present disclosure. The wellsite can be onshore or offshore. A borehole 102 is formed in subsurface formations by directional drilling. A drill string 104 extends from a drill rig 106 and is suspended within the borehole 102. In some embodiments, the wellsite system 100 implements directional drilling using a rotary steerable system (RSS). For instance, the drill string 104 is rotated from the surface, and down hole devices move the end of the drill string 104 in a desired direction. The drill rig 106 includes a platform and derrick assembly positioned over the borehole 102. In some embodiments, the drill rig 106 includes a rotary table 108, kelly 110, hook 112, rotary swivel 114, and so forth. For example, the drill string 104 is rotated by the rotary table 108, which engages the kelly 110 at the upper end of the drill string 104. The drill string 104 is suspended from the hook 112 using the rotary swivel 114, which permits rotation of the drill string 104 relative to the hook 112. However, this configuration is provided by way of example and is not meant to limit the present disclosure. For instance, in other embodiments a top drive system is used.

A bottom hole assembly (BHA) 116 is suspended at the end of the drill string 104. The bottom hole assembly 116 includes a drill bit 118 at its lower end. In embodiments of the disclosure, the drill string 104 includes a number of drill pipes 120 that extend the bottom hole assembly 116 and the drill bit 118 into subterranean formations. Drilling fluid (e.g., mud) 122 is stored in a tank and/or a pit 124 formed at the wellsite. The drilling fluid 122 can be water-based, oil-based, and so on. A pump 126 displaces the drilling fluid 122 to an interior passage of the drill string 104 via, for example, a port in the rotary swivel 114, causing the drilling fluid 122 to flow downwardly through the drill string 104 as indicated by directional arrow 128. The drilling fluid 122 exits the drill string 104 via ports (e.g., courses, nozzles) in the drill bit 118, and then circulates upwardly through the annulus region between the outside of the drill string 104 and the wall of the borehole 102, as indicated by directional arrows 130. In this manner, the drilling fluid 122 cools and lubricates the drill bit 118 and carries drill cuttings generated by the drill bit 118 up to the surface (e.g., as the drilling fluid 122 is returned to the pit 124 for recirculation). Further, destabilization of the rock in the wellbore can be at least partially prevented, the pressure of fluids inside the rock can be at least partially overcome so that the fluids do not enter the wellbore, and so forth.

In embodiments of the disclosure, the drill bit 118 includes one or more crushing and/or cutting implements, such as conical cutters and/or bit cones having spiked teeth (e.g., in the manner of a roller-cone bit). In this configuration, as the drill string 104 is rotated, the bit cones roll along the bottom of the borehole 102 in a circular motion. As they roll, new teeth come in contact with the bottom of the borehole 102, crushing the rock immediately below and around the bit tooth. As the cone continues to roll, the tooth then lifts off the bottom of the hole and a high-velocity drilling fluid jet strikes the crushed rock chips to remove them from the bottom of the borehole 102 and up the annulus. As this occurs, another tooth makes contact with the bottom of the borehole 102 and creates new rock chips. In this manner, the process of chipping the rock and removing the small rock chips with the fluid jets is continuous. The teeth intermesh on the cones, which helps clean the cones and enables larger teeth to be used. A drill bit 118 including a conical cutter can be implemented as a steel milled-tooth bit, a tungsten carbide insert bit, and so forth. However, roller-cone bits are provided by way of example and are not meant to limit the present disclosure. In other embodiments, a drill bit 118 is arranged differently. For example, the body of the drill bit 118 includes one or more polycrystalline diamond compact (PDC) cutters that shear rock with a continuous scraping motion.

In some embodiments, the bottom hole assembly 116 includes a logging-while-drilling (LWD) module 132, a measuring-while-drilling (MWD) module 134, a rotary steerable system 136, a motor, and so forth (e.g., in addition to the drill bit 118). The logging-while-drilling module 132 can be housed in a drill collar and can contain one or a number of logging tools. It should also be noted that more than one LWD module and/or MWD module can be employed (e.g. as represented by another logging-while-drilling module 138). In embodiments of the disclosure, the logging-while drilling modules 132 and/or 138 include capabilities for measuring, processing, and storing information, as well as for communicating with surface equipment, and so forth.

The measuring-while-drilling module 134 can also be housed in a drill collar, and can contain one or more devices for measuring characteristics of the drill string 104 and drill bit 118. The measuring-while-drilling module 134 can also include components for generating electrical power for the down hole equipment. This can include a mud turbine generator powered by the flow of the drilling fluid 122. However, this configuration is provided by way of example and is not meant to limit the present disclosure. In other embodiments, other power and/or battery systems can be employed. The measuring-while-drilling module 134 can include one or more of the following measuring devices: a direction measuring device, an inclination measuring device, and so on. Further, a logging-while-drilling module 132 and/or 138 can include one or more measuring devices, such as a weight-on-bit measuring device, a torque measuring device, a vibration measuring device, a shock measuring device, a stick slip measuring device, and so forth.

In some embodiments, the wellsite system 100 is used with controlled steering or directional drilling. For example, the rotary steerable system 136 is used for directional drilling. As used herein, the term "directional drilling" describes intentional deviation of the wellbore from the path it would naturally take (e.g., vertical). Thus, directional drilling refers to steering the drill string 104 so that it travels in a desired direction. In some embodiments, directional drilling is used for offshore drilling (e.g., where multiple wells are drilled from a single platform). In some embodiments, directional drilling enables horizontal drilling through a reservoir, which enables a longer length of the wellbore to traverse the reservoir, increasing the production rate from the well. Further, directional drilling may be used in vertical drilling operations. For example, the drill bit 118 may veer off of a planned drilling trajectory because of the unpredictable nature of the formations being penetrated or the varying forces that the drill bit 118 experiences. When such deviation occurs, the wellsite system 100 may be used to guide the drill bit 118 back on course.

The drill string 104 can include one or more extendable displacement mechanisms, such as a piston mechanism that can be actuated by an actuator to displace a pad toward, for instance, a borehole wall to cause the bottom hole assembly 116 to move in a desired direction of deviation. In embodiments of the disclosure, a displacement mechanism can be actuated by the drilling fluid 122 routed through the drill string 104. For example, the drilling fluid 122 is used to move a piston, which changes the orientation of the drill bit 118 (e.g., changing the drilling axis orientation with respect to a longitudinal axis of the bottom hole assembly 116). The displacement mechanism may be employed to control a directional bias and/or an axial orientation of the bottom hole assembly 116. Displacement mechanisms may be arranged, for example, to point the drill bit 118 and/or to push the drill bit 118. In some embodiments, a displacement mechanism is deployed by a drilling system using a rotary steerable system 136 that rotates with a number of displacement mechanisms. It should be noted that the rotary steerable system 136 can be used in conjunction with stabilizers, such as non-rotating stabilizers, and so on.

In some embodiments, a displacement mechanism is positioned proximate to the drill bit 118. However, in other embodiments, a displacement mechanism can be positioned at various locations along a drill string, a bottom hole assembly, and so forth. For example, in some embodiments, a displacement mechanism is positioned in a rotary steerable system 136, while in other embodiments, a displacement mechanism can be positioned at or near the end of the bottom hole assembly 116 (e.g., proximate to the drill bit 118). In some embodiments, the drill string 104 can include one or more filters that filter the drilling fluid 122 (e.g., upstream of the displacement mechanism with respect to the flow of the drilling fluid 122).

The wellsite system 100 can include a control module (e.g., a terminal 140) with a user interface for steering an equipment string, such as the drill string 104. In embodiments, the user interface can be presented to an operator of the equipment. For instance, the user interface can be located at, for example, a drill rig. However, in other embodiments, a user interface can be at a remote location. For instance, the user interface can be implemented in a system that hosts software and/or associated data in the cloud. The software can be accessed by a client device (e.g., a mobile device) with a thin client (e.g., via a web browser).

Referring now to FIGS. 2 through 15, example systems and apparatus are described that can provide steering functionality for an equipment string, such as the drill string 104 described with reference to FIG. 1. The example systems and apparatus can actuate a steering mechanism based upon a rotational orientation of a bearing housing with respect to the steering mechanism. In embodiments of the disclosure, the equipment string traverses a tubular passage (e.g., the borehole 102 described with reference to FIG. 1). For example, a drill string 200 traverses a tubular passage from an entrance end of the passage (e.g., proximate to the surface) to an opposing end of the passage (e.g., to the bottom of the borehole 102). In some embodiments, the bearing housing is connected to a drill pipe and can be rotated from the entrance end of the passage. For instance, with reference to FIG. 1, the drill string 104 is rotated by the rotary table 108, which engages the kelly 110 at the upper end of the drill string 104. In other embodiments, the bearing housing can be rotated from another location along the length of the equipment string. For example, an orienter can be used in a drill string to rotate the bearing housing in a controlled manner (e.g., at the bottom hole assembly 116 described with reference to FIG. 1). The drill string 200 can include a mud motor bearing section, and a transmission and power section. Further, the drill string 200 may include one or more power sources, including, but not necessarily limited to: batteries, an alternator (e.g., between the driveshaft and the bearing housing and/or with a turbine in the central flow channel of the driveshaft), and so forth.

In embodiments of the disclosure, a drill string 200 includes an implement 202 (e.g., a steering implement, a working implement with steering functionality, and/or another implement). The implement 202 can be tethered to the drill string 200. For instance, the implement 202 can be rotationally coupled with a bearing housing 204 of the drill string 200, which supports the implement 202. In embodiments of the disclosure, the bearing housing 204 can include one or more bearings 206. The bearing housing 204 may be connected to one or more drill pipes of the drill string 200 and may rotate with the drill pipe(s). For instance, a bearing housing 204 can be connected to a drill pipe 120 (e.g., as described with reference to FIG. 1) that extends the bottom hole assembly 116 and the drill bit 118 into subterranean formations.

In some embodiments, an implement 202 tethered to the end of a drill string 200 can be a steering tool (e.g., as described with reference to FIGS. 2 through 8 and 10 through 14). In other embodiments, a drill string 200 can include a working implement 202, such as a bit (e.g., the drill bit 118 described with reference to FIG. 1), having a steering mechanism. For instance, an implement 202 including a drill bit can be tethered at the end of a drill string 200 (e.g., as described with reference to FIG. 9). The bit can be rotationally coupled with a bearing housing 204, which supports the bit. Additionally, a working implement can also be coupled with an implement 202 including a steering mechanism. For example, a drill bit can be tethered to the end of an implement 202 (e.g., as described with reference to FIGS. 2 through 8 and 10 through 14), or to another drill pipe 120 coupled with such an implement 202. However it should be noted that these configurations are provided by way of example and are not meant to limit the present disclosure. In other embodiments, apparatus, systems, and techniques as described herein can be used with other down hole operations.

The implement 202 includes a steering mechanism 208 (e.g., a pad 210) to steer the implement 202 with respect to a wall of the tubular passage and/or to orient the implement 202 with respect to the wall (e.g., with respect to a wall of the borehole 102 described with reference to FIG. 1). In some embodiments, the steering mechanism 208 is extendable from the implement 202 toward the wall of the passage. For instance, one or more pads 210 of the steering mechanism 208 can be extended to steer the implement 202 (e.g., away from the borehole wall). In embodiments of the disclosure, the drill string 200 also includes an actuation mechanism 212 coupled between the bearing housing 204 and the steering mechanism 208 to actuate the steering mechanism 208 based upon a rotational orientation of the bearing housing 204 with respect to the steering mechanism 208.

In some embodiments, the steering mechanism 208 is actuated based upon one or more values from a sensor 214 (e.g., as described with reference to FIG. 15). For example, the steering mechanism 208 is actuated by a fluid connection 216 that is established between the bearing housing 204 and the steering mechanism 208 as the implement 202 rotates with respect to the bearing housing 204 (e.g., as described with reference to FIGS. 2-13). In another example, the steering mechanism 208 is actuated by a mechanical connection 218 that is established between the bearing housing 204 and the steering mechanism 208 as the implement 202 rotates with respect to the bearing housing 204 (e.g., as described with reference to FIG. 14). In a further example, the steering mechanism 208 is actuated by an electrical connection 220 that is established between the bearing housing 204 and the steering mechanism 208 as the implement 202 rotates with respect to the bearing housing 204 (e.g., as described with reference to FIG. 3). In another example, the steering mechanism 208 is actuated by an inductive connection that is established between the bearing housing 204 and the steering mechanism 208 as the implement 202 rotates with respect to the bearing housing 204 (e.g., using an inductive sensor). In a further example, the steering mechanism 208 is actuated by a magnetic connection that is established between the bearing housing 204 and the steering mechanism 208 as the implement 202 rotates with respect to the bearing housing 204 (e.g., using a magnetic sensor).

Figure 2:
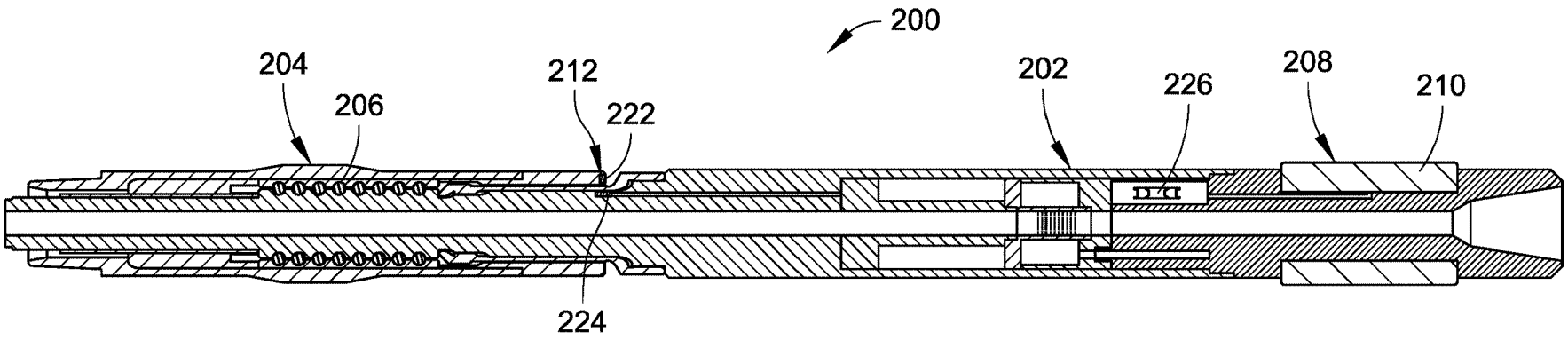
FIG. 2 illustrates another example system in which embodiments of Equipment String Communication and Steering can be implemented.

Referring now to FIG. 2, an actuation mechanism 212 can be implemented using one or more magnets 222 (e.g., a permanent magnet, such as a rare-earth magnet, an electromagnetic, a magnetized material, etc.) attached to the bearing housing 204 and one or more magnetic field sensors 224 attached to the implement 202 (e.g., a magnetometer, a Hall effect sensor that varies output voltage in response to a magnetic field, and/or another magnetic field sensor). The magnetic field sensors 224 can be coupled with controller circuitry and used to actuate a valve 226 (e.g., a hydraulic valve) in response to signals detected from the magnet 222 as the magnet 222 connected to the bearing housing 204 rotates with respect to the magnetic field sensor 224 connected to the implement 202. In this manner, as the position of a magnet 222 is detected in proximity to a magnetic field sensor 224, a corresponding hydraulic valve 226 can be actuated to extend an associated pad 210 toward a wall of the borehole and steer the implement 202. In some embodiments, a pad 210 can be connected to a piston mechanism, and the piston can be actuated by drilling fluid routed through the drill string 200 (e.g., the drilling fluid 122 described with reference to FIG. 1). Further, multiple valves 226, pistons, and/or associated pads 210 can be provided (e.g., with three pistons, four pistons, more than four pistons, etc.). In some embodiments, one or more filters can also be used to filter the drilling fluid (e.g., from the flow channel of the driveshaft to the steering unit).

In this manner, the actuation mechanism 212 can include one or more hydraulic valves 226 that establish fluid connections between the bearing housing 204 and the steering mechanism 208 at one or more rotational orientations of the bearing housing 204 with respect to the steering mechanism 208 (e.g., predetermined or set rotational orientations of the bearing housing with respect to the steering mechanism). However magnets 222 and associated magnetic field sensors 224 are provided by way of example and are not meant to limit the present disclosure. In other embodiments, an actuation mechanism 212 can be implemented using a brush or another electrical contact (e.g., an electrically conductive element that conducts electrical current between the bearing housing 204 and the implement 202) so that an electrical connection actuates a hydraulic valve 226 at a predetermined rotational orientation of the bearing housing 204 with respect to the steering mechanism 208.

Figure 3:
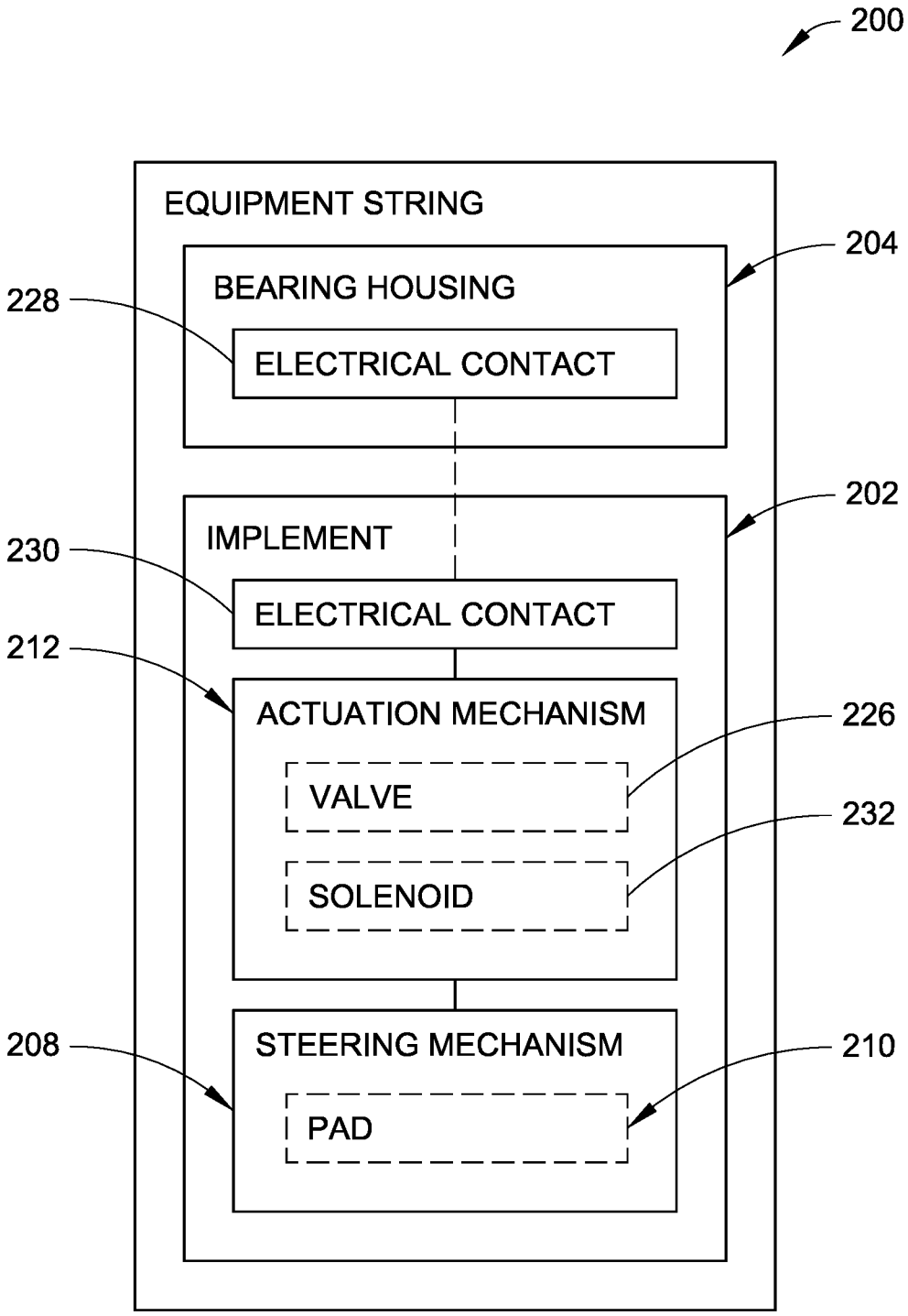
FIG. 3 illustrates another example system in which embodiments of Equipment String Communication and Steering can be implemented.

Referring to FIG. 3, an electrical contact 228 (e.g., a brush, an electrically conductive slip ring, and so on) can be attached to the bearing housing 204, and the implement 202 can include one or more sensors (e.g., electrical contacts 230) that can be connected to a source of electrical current by the brush. The electrical contacts 230 can be coupled with controller circuitry to actuate one or more valves 226 of the actuation mechanism 212 when an electrical circuit is completed by the electrical contact 228 as the electrical contact 228 rotates with respect to the implement 202. In this manner, as the position of the brush is detected in proximity to an electrical contact 230, a corresponding hydraulic valve 226 can be actuated to extend an associated pad 210 toward a wall of the borehole and steer the implement 202. It should be noted that the valves 226 described with reference to FIGS. 2 and 3 are provided by way of example and are not meant to limit the present disclosure. In other embodiments, an actuation mechanism 212 can include one or more other actuators, including, but not limited to, a solenoid 232 or another transducer device that converts energy into motion. For instance, a pad 210 can be connected to the solenoid 232, and the solenoid 232 can be actuated by an electrical connection established between the bearing housing 204 and the steering mechanism 208 as the implement 202 rotates with respect to the bearing housing 204 to extend the pad 210.

It should be noted that while the hydraulic valves 226 and solenoids 232 have been described as steering the implement 202 by extending associated pads 210 toward a borehole wall with some specificity, these examples are not meant to limit the present disclosure. In other embodiments, actuators can be used to steer an implement by orienting the implement 202 with respect to a wall of the tubular passage (e.g., with respect to the borehole wall). For example, a working implement 202, such as a drill bit, can be connected to the drill string 200 using, for example, a sleeve with a universal joint. A steering mechanism 208 can be used to orient the implement 202 with respect to the wall by pointing the sleeve using one or more pistons, cams, and/or other devices to control the angle of the implement 202 with respect to the drill string 200. The pistons and/or cams can be actuated based upon the position of a magnet 222 in proximity to a magnetic field sensor 224, the position of a brush in proximity to an electrical contact 230, and so forth (e.g., as previously described).

Figure 4:
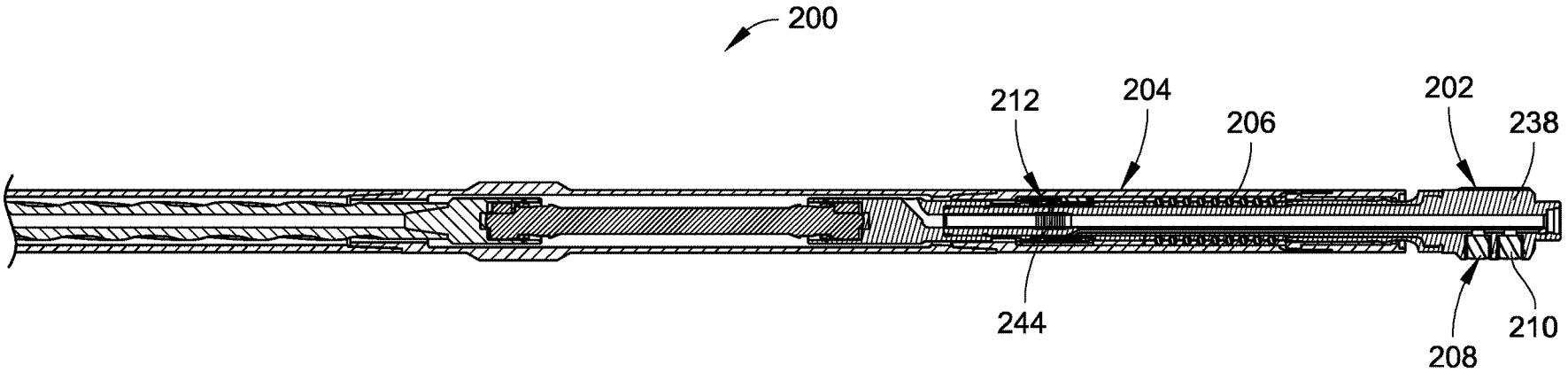
FIG. 4 illustrates another example system in which embodiments of Equipment String Communication and Steering can be implemented.
Figure 5:
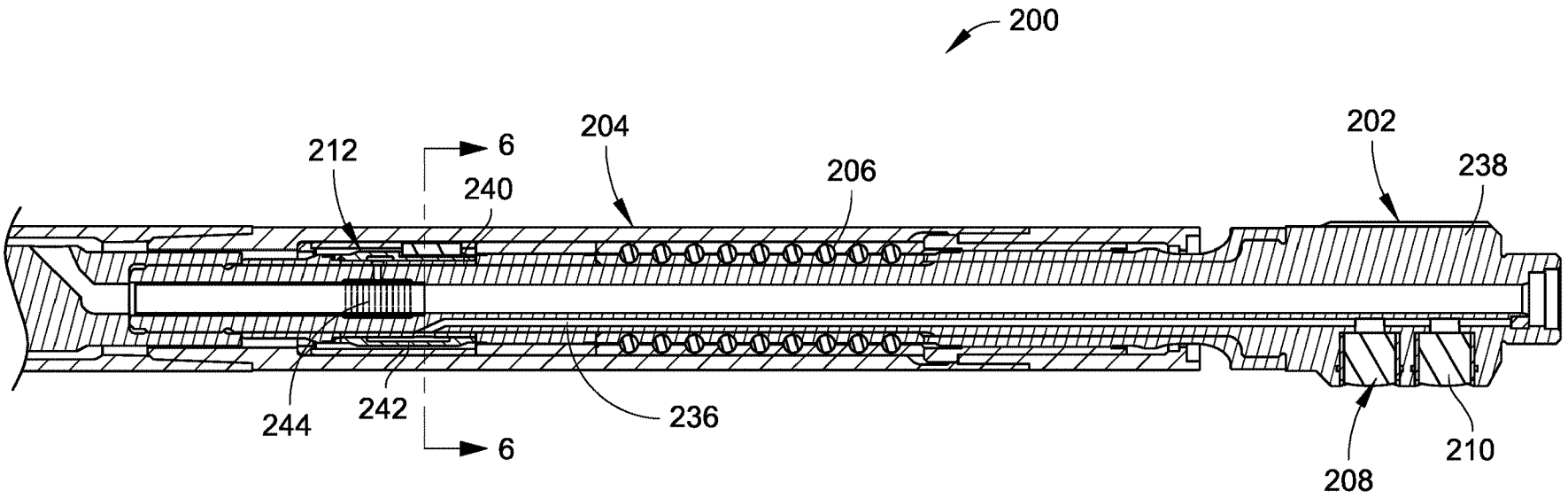
FIG. 5 is another illustration of the system of FIG. 4.
Figure 6:
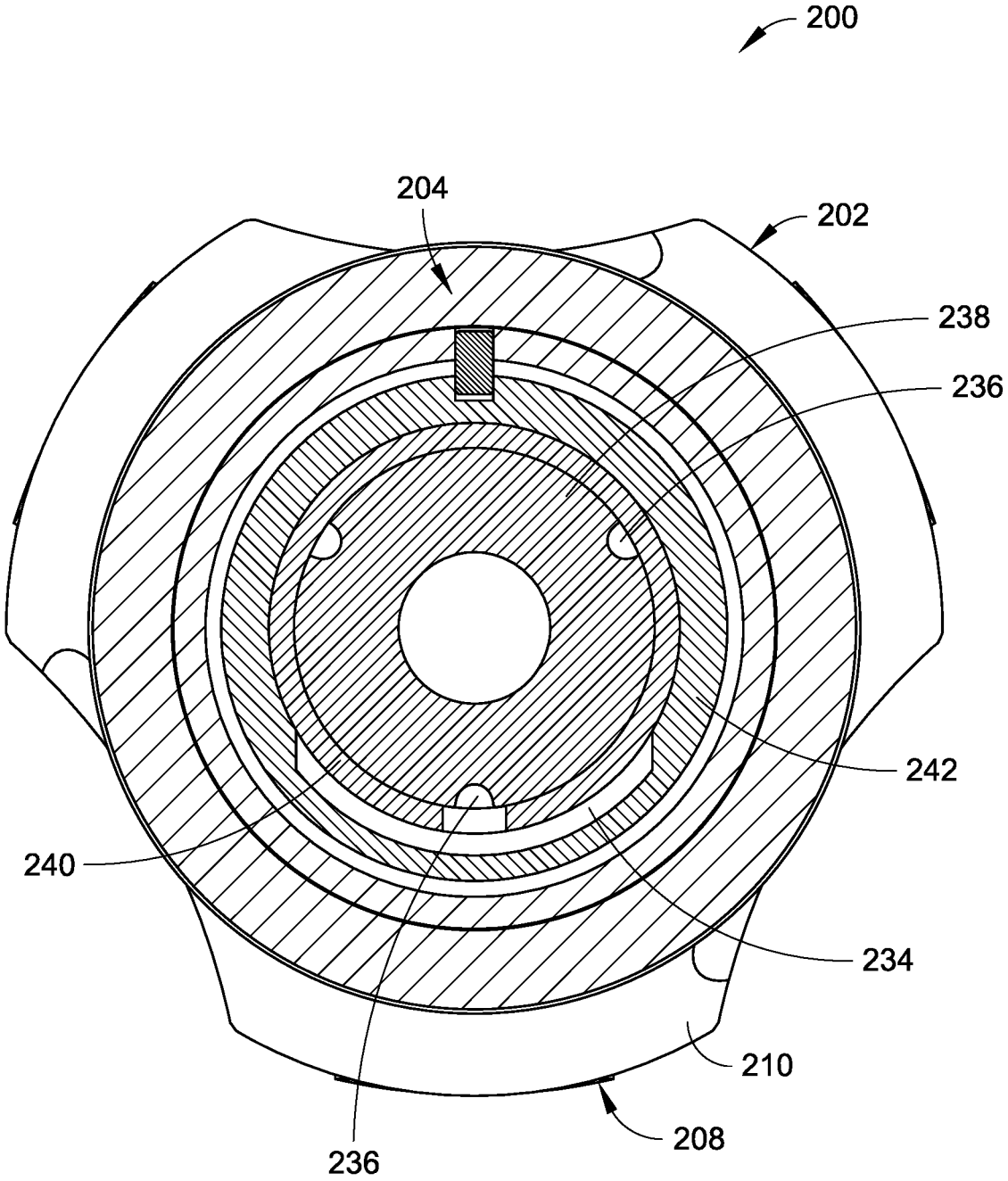
FIG. 6 is a further illustration of the system of FIG. 4.

In some embodiments, a drill string 200 can include fluid passages that extend through the driveshaft from the pistons in the steering unit below to a rotary valve above. The rotary valve may include multiple ports on the driveshaft (e.g., in the manner of a rotor) and a port rotationally locked to the bearing housing (e.g., in the manner of a stator). In this configuration, the actuator pistons can be continually actuated when the tool is in rotary mode. The direction of actuation changes with the rotation of the bearing housing, which may stabilize the tool and/or the bit in the borehole. With reference to FIGS. 4 through 6, an actuation mechanism 212 of a drill string 200 can include a port 234 in the bearing housing 204 and one or more ports 236 in the implement 202 so that the port 234 and a port 236 can be aligned in fluid communication to establish a fluid connection between the bearing housing 204 and the steering mechanism 208 at a predetermined rotational orientation of the bearing housing 204 with respect to the steering mechanism 208. In some embodiments, the implement 202 can be a working implement, such as a drill bit.

In embodiments of the disclosure, gun drilled ports 236 in the implement 202 extend to pads 210 in the bit. A driveshaft 238 can be connected to a rotor 240 and can include the ports 236. The rotor 240 rotates with the driveshaft 238, and a port 236 aligns with a port 234 in a valve stator 242. Drilling fluid routed through the drill string 200 (e.g., the drilling fluid 122 described with reference to FIG. 1) moves from a central bore of the driveshaft 238 radially outward to the valve stator 242. The valve stator 242 rotates with the bearing housing 204, while floating with respect to the rotor 240. For example, the valve stator 242 is rotationally locked to the bearing housing 204, but can move radially with the driveshaft 238. This configuration may allow the gap between the valve stator 242 and the driveshaft 238 to be reduced and/or minimized. The gap may control leakage of pressurized fluid from the internal part of the tool to any piston port that is not activated and at annulus pressure. In some embodiments, the drill string 200 includes an inline filter 244 (e.g., for filtering fast moving drilling fluid). In embodiments of the disclosure, the drilling fluid moves from the port 234 to a port 236, and then axially down to a piston connected to a pad 210 to extend the pad 210 (or, e.g., to a piston that acts as a pad).

Figure 7:
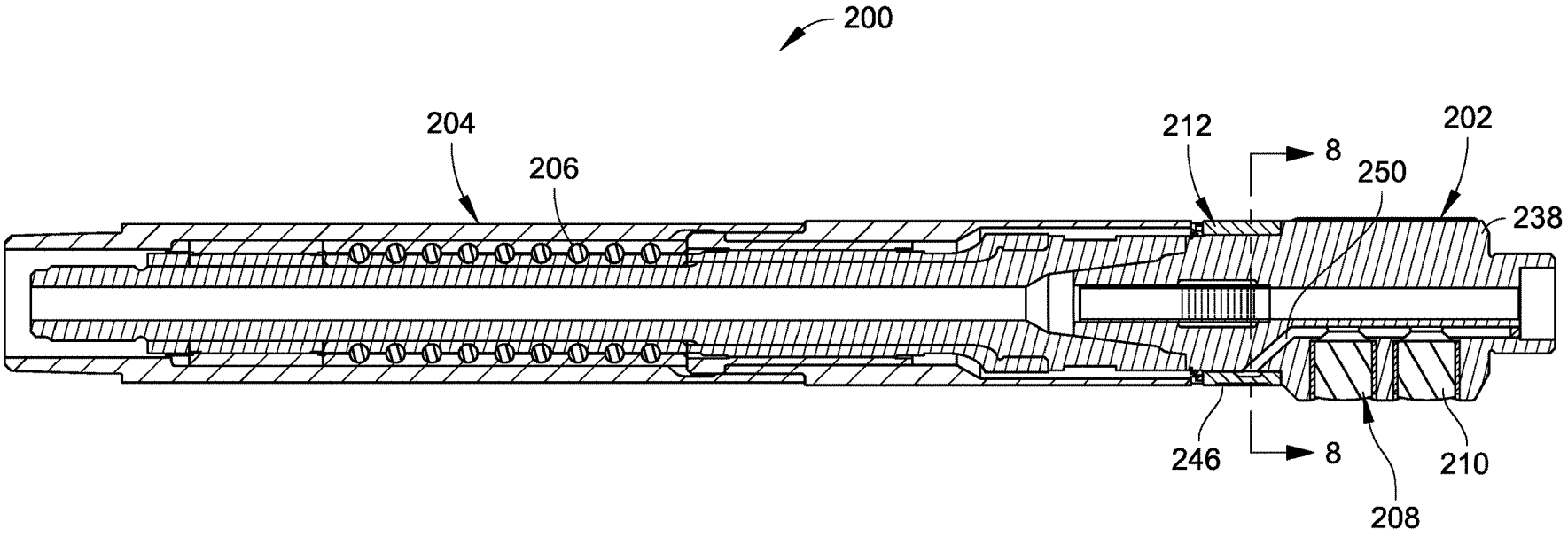
FIG. 7 illustrates another example system in which embodiments of Equipment String Communication and Steering can be implemented.
Figure 8:
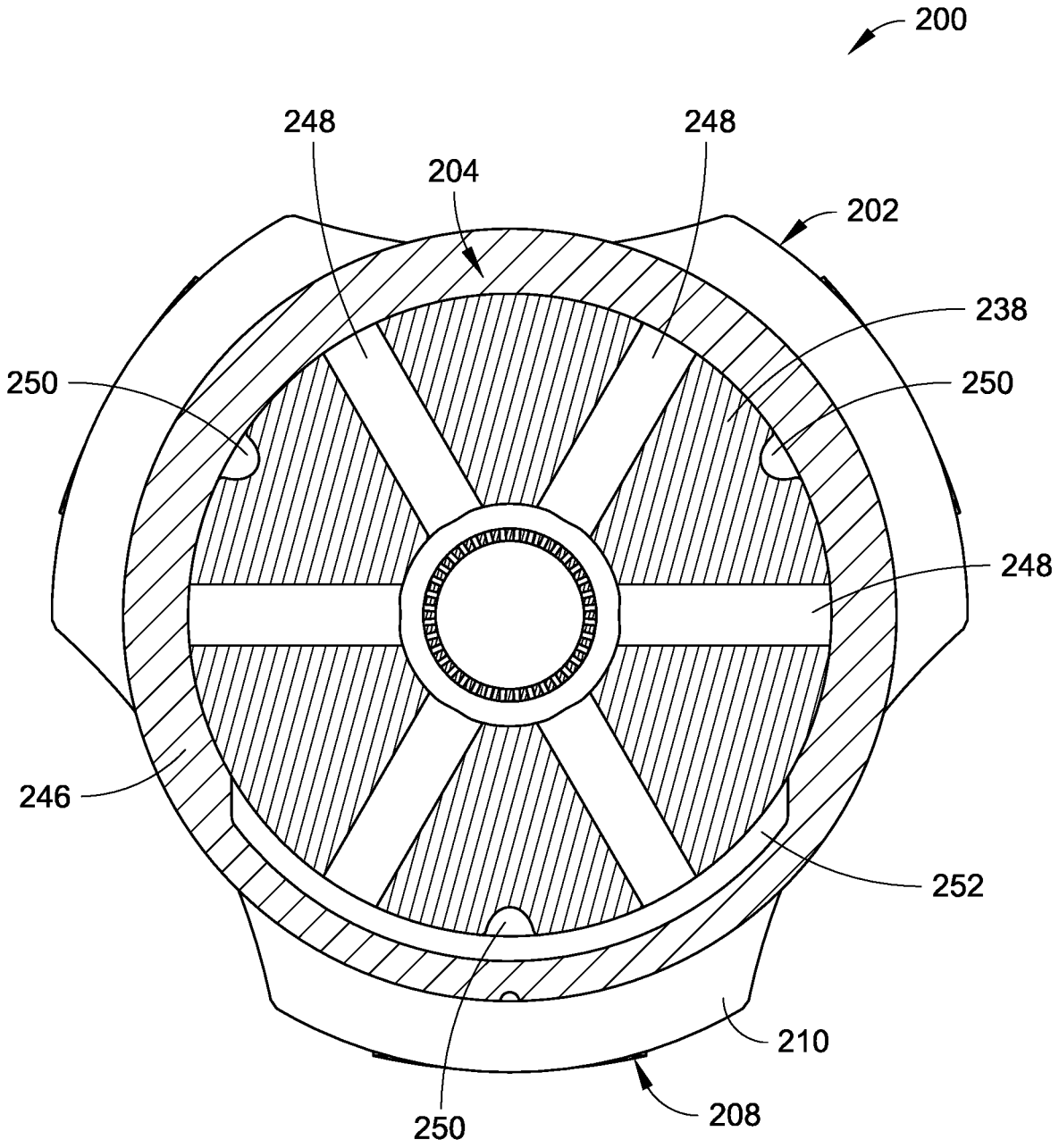
FIG. 8 is a further illustration of the system of FIG. 7.
Figure 9:
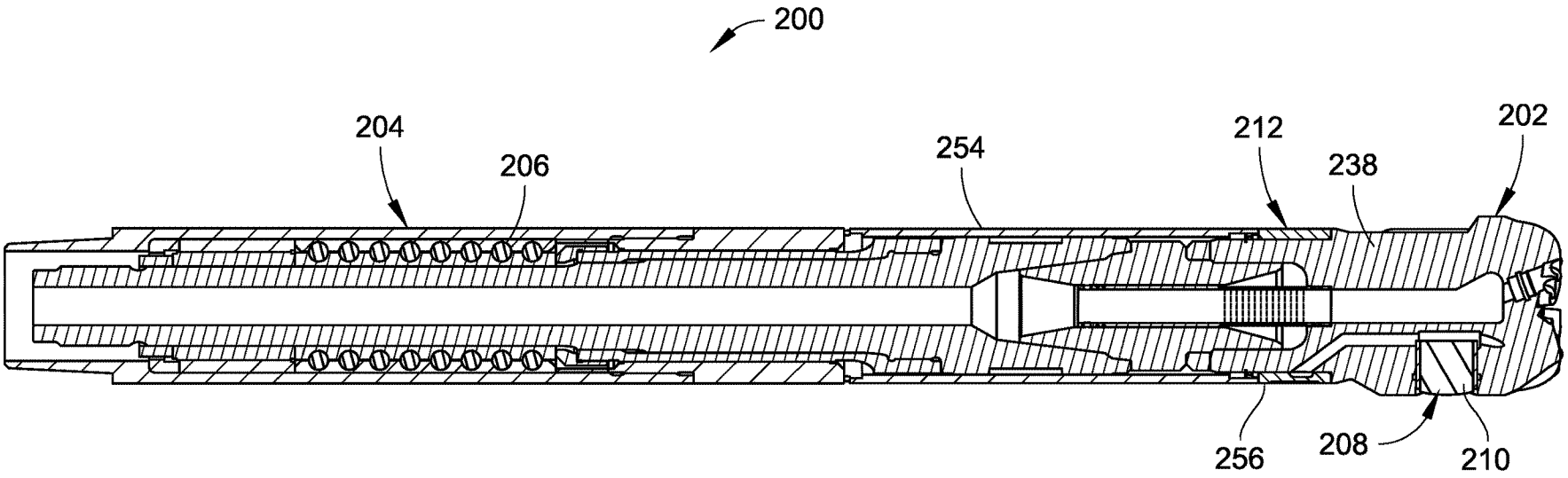
FIG. 9 illustrates another example system in which embodiments of Equipment String Communication and Steering can be implemented.

Referring now to FIGS. 7 and 8, an annular rotary valve 246 can rotate on the outside at an end of a bearing housing 204 to establish a fluid connection between the bearing housing 204 and a steering mechanism 208 at a predetermined rotational orientation of the bearing housing 204 with respect to the steering mechanism 208. A driveshaft 238 can include one or more (e.g., six) entry ports 248 for drilling fluid (e.g., the drilling fluid 122 described with reference to FIG. 1) and one or more (e.g., three) exit ports 250 for the drilling fluid. The annular rotary valve 246 can include a port 252 that aligns with an exit port 250 to establish a fluid connection between the bearing housing 204 and the steering mechanism 208. In embodiments of the disclosure, drilling fluid moves from a central bore of the driveshaft 238 radially outward to the port 252, to an exit port 250, and then to a piston connected to a pad 210 to extend the pad 210. In other embodiments, an annular valve may be located in the driveshaft bit box. With reference to FIG. 9, a drive sleeve 254 connected to the bearing housing 204 (and/or to another part of a lower radial bearing) can be positioned over the top of a driveshaft 238. A valve 256 (e.g., an axial valve or a radial valve) can be controlled between the driveshaft 238 and the drive sleeve 254 (e.g., as previously described).

Figure 10:
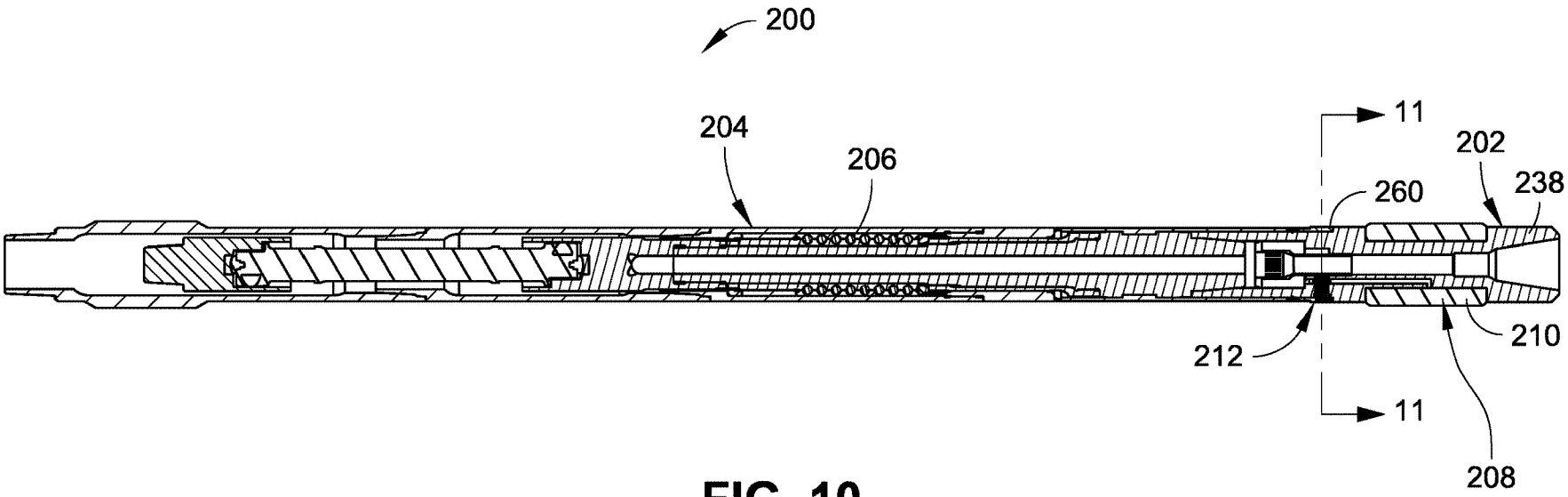
FIG. 10 illustrates another example system in which embodiments of Equipment String Communication and Steering can be implemented.
Figure 11:
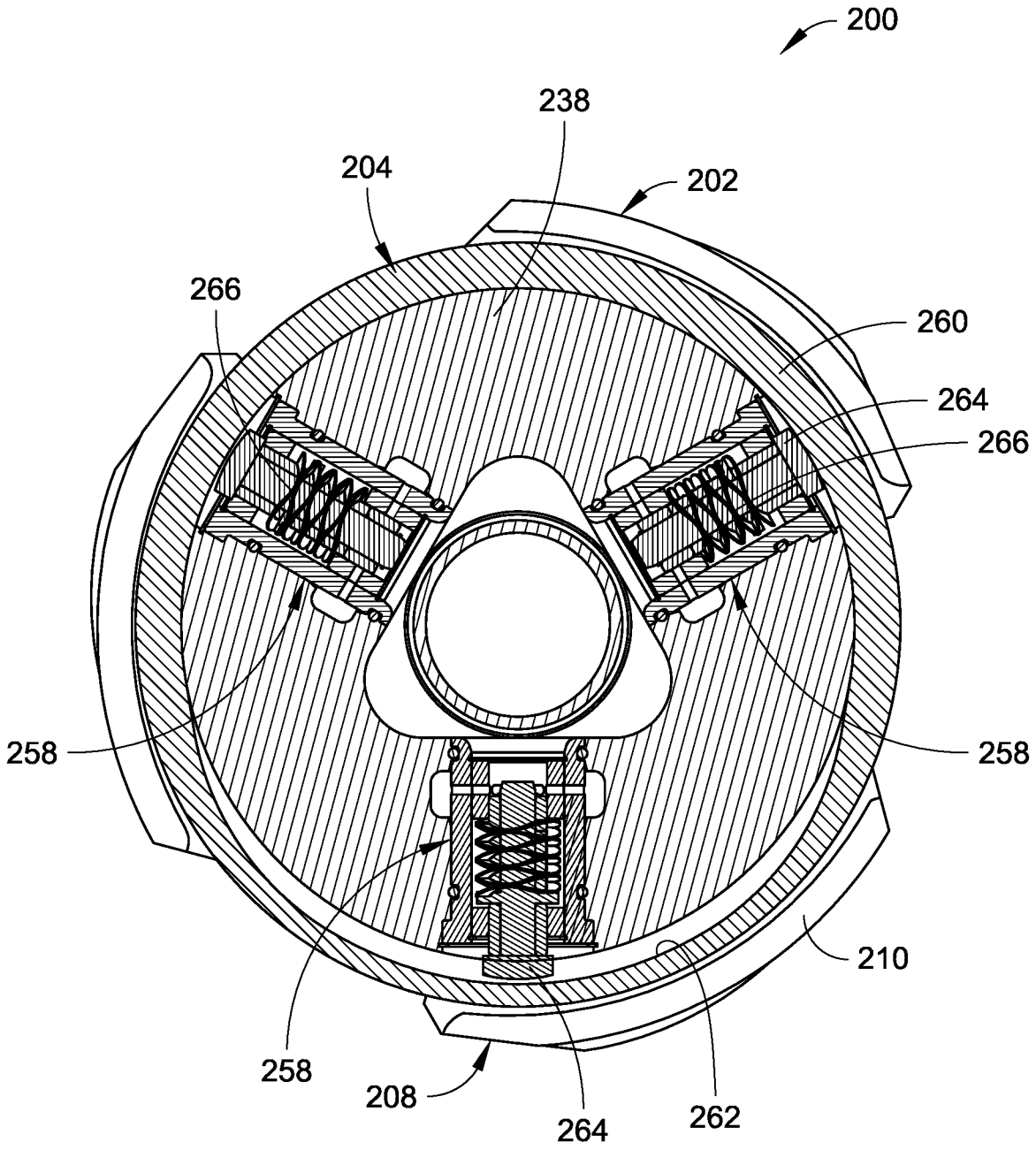
FIG. 11 is a further illustration of the system of FIG. 10.

Referring to FIGS. 10 and 11, in some embodiments a valve, such as a linear hydraulic valve 258, can be actuated by a biasing device at a predetermined rotational orientation of a bearing housing 204 with respect to a steering mechanism 208. For example, a hydraulic valve 258 is biased by a cam, such as a cam stator 260 having a radial cam cutout 262, e.g., using cam followers 264 with compression springs 266 and/or differential pressure from drilling fluid (e.g., the drilling fluid 122 described with reference to FIG. 1). The cam stator 260 can be positioned at an end of a bearing housing 204 to rotate with the bearing housing 204. In embodiments of the disclosure, drilling fluid moves from a central bore of a driveshaft 238 radially outward to hydraulic valves 258 in the driveshaft 238, through a hydraulic valve 258 that is opened when its cam follower 264 is aligned with the radial cam cutout 262, and then to a piston connected to a pad 210 to extend the pad 210. In some embodiments, one or more of the hydraulic valves 258 may be a valve cartridge, which can be removed for servicing. However, it should be noted that a cam biasing device is provided by way of example and is not meant to limit the present disclosure. In other embodiments, a linear valve can be actuated by another biasing device, such as a magnet that repels and/or attracts magnetic components of the valve. Further, while linear valves have been described with some specificity, another type of valve may be used, such as a rotary valve.

Figure 12:
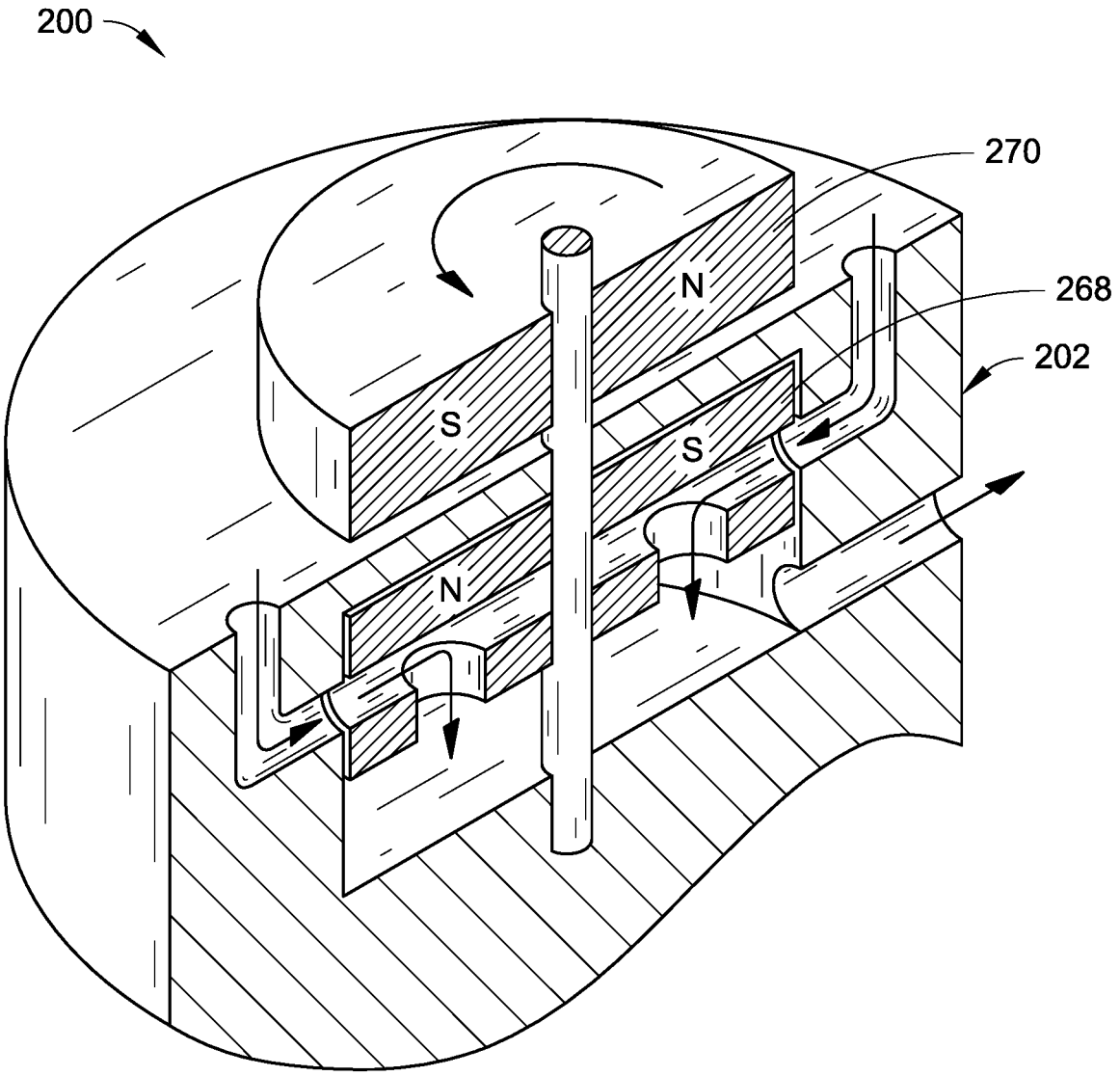
FIG. 12 illustrates another example system in which embodiments of Equipment String Communication and Steering can be implemented.

With reference to FIG. 12, a rotary valve 268 that includes magnetic material can be disposed in an implement 202 and biased by a magnetic device 270 connected to a bearing housing (not shown) to actuate the rotary valve 268 at a predetermined rotational orientation of the bearing housing with respect to a steering mechanism (not shown). Drilling fluid routed through a drill string 200 (e.g., the drilling fluid 122 described with reference to FIG. 1) can move through the rotary valve 268, which is opened when poles of the magnetic device 270 are aligned with poles of the rotary valve 268, and then, for instance, to a piston connected to a pad to extend the pad.

Figure 13:
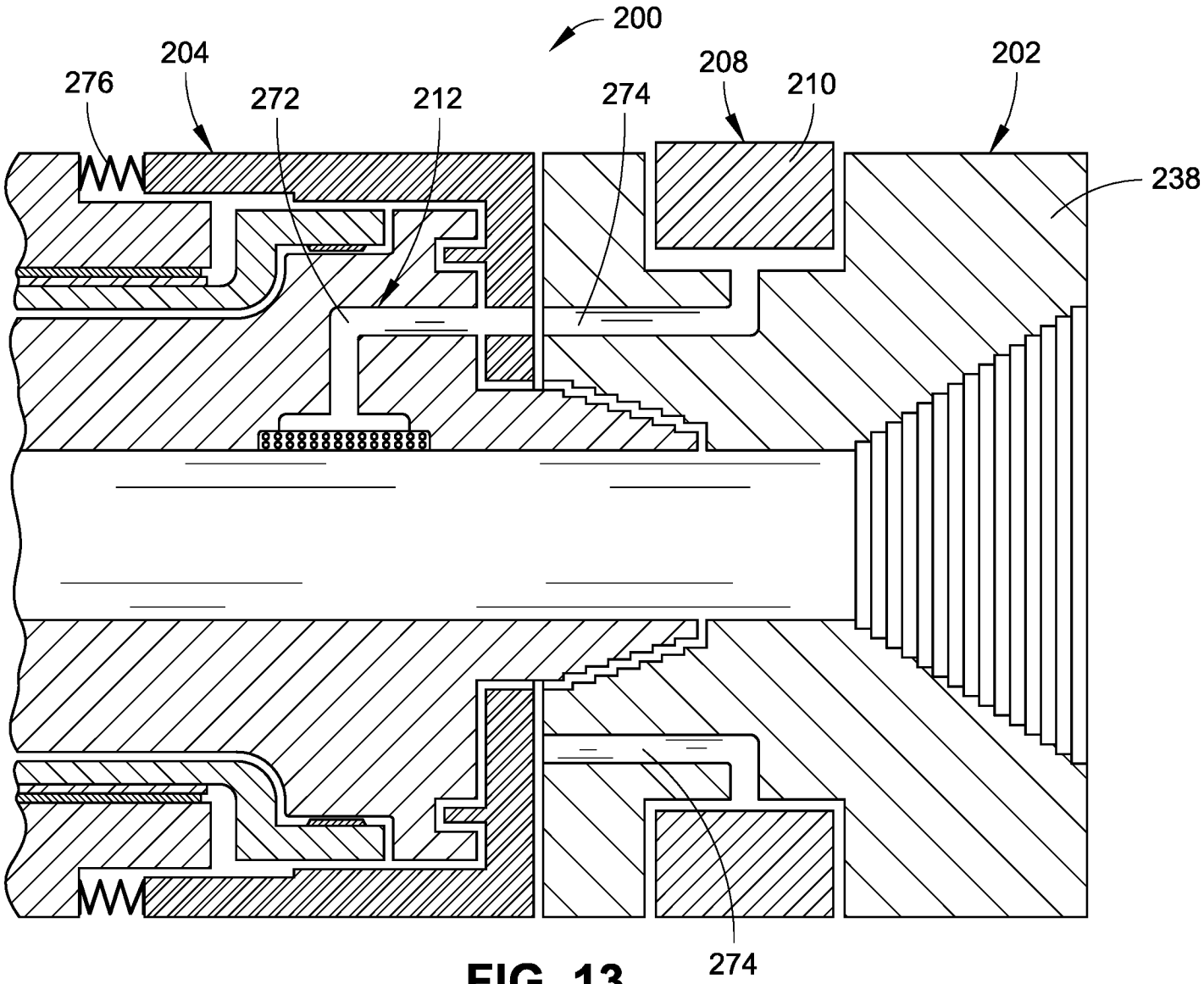
FIG. 13 illustrates another example system in which embodiments of Equipment String Communication and Steering can be implemented.

Referring now to FIG. 13, an actuation mechanism 212 of a drill string 200 can include a port 272 in the bearing housing 204 (e.g., a stator) and one or more ports 274 in the implement 202 (e.g., a rotor) so that the port 272 and a port 274 can be aligned in fluid communication to establish a fluid connection between the bearing housing 204 and the steering mechanism 208 at a rotational orientation of the bearing housing 204 with respect to the steering mechanism 208 (e.g., a predetermined or set rotational orientation of the bearing housing with respect to the steering mechanism. In embodiments of the disclosure, the ports 274 can extend to pads 210 (e.g., in a driveshaft 238). Drilling fluid routed through the drill string 200 (e.g., the drilling fluid 122 described with reference to FIG. 1) moves from a central bore of the driveshaft 238 radially outward to the port 272, which rotates with the bearing housing 204. The drilling fluid moves axially through the port 272 to the port 274, and then axially down to a piston connected to a pad 210 to extend the pad 210. The drill string 200 may also include one or more springs 276 (e.g., for a spline).

Figure 14:
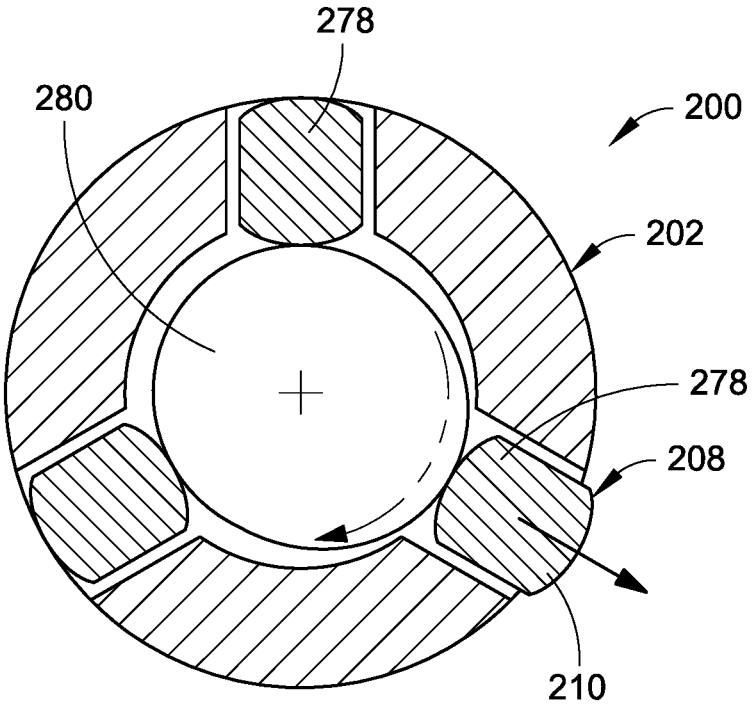
FIG. 14 illustrates another example system in which embodiments of Equipment String Communication and Steering can be implemented.

With reference to FIG. 14, in some embodiments an implement 202 has a steering mechanism 208 that includes one or more pistons 278 driven by a cam 280. For example, the cam 280 is connected to a bearing housing (not shown) to rotate with the bearing housing. In this manner, a mechanical connection can be established between the bearing housing and the steering mechanism 208 at a rotational orientation of the bearing housing with respect to the steering mechanism 208 (e.g., at a set or predetermined rotational orientation) e.g., to extend a piston 278.

In embodiments of the disclosure, the apparatus and systems described herein can be used to communicate with an implement 202 tethered to an equipment string, such as a drill string 200, and/or to control operations of the implement 202. For example, the implement 202 can be steered (e.g., during a directional drilling operation). Referring to FIG. 15, in some embodiments the implement 202 has one or more sensors 282, which can include, but are not necessarily limited to, a gyroscope 284, a magnetometer 286, an accelerometer, and so forth. As previously described, the drill string 200 may also have one or more sensors 214, which can include, but are not necessarily limited to, a fluid connection 216 (e.g., as described with reference to FIGS. 2-13), a mechanical connection 218 (e.g., as described with reference to FIG. 14), an electrical connection 220 (e.g., as described with reference to FIG. 3), an inductive connection (e.g., using an inductive sensor), a magnetic connection (e.g., using a magnetic sensor), and so forth. The sensors 214 and/or 282 can determine one or more rotational characteristics of the bearing housing 204 with respect to a borehole, the implement 202 with respect to a borehole, the implement 202 with respect to the bearing housing 204, and so forth. Example rotational characteristics include, but are not necessarily limited to, a rotational speed, a rotational velocity, an angle of rotation, and so forth.

In an example, a driveshaft revolutions per minute (RPM) measurement from a sensor 282 and a relative RPM measurement between the driveshaft 238 and the bearing housing 204 from a sensor 214 can be used to determine an absolute RPM of the bearing housing 204 (e.g., with respect to the borehole). In some embodiments, actuation of the valves previously described can be adjusted depending upon whether the tool is sliding or rotating. For instance, in a sliding mode, the valves 226 described with reference to FIGS. 2 and 3 can be actuated once per revolution (e.g., as they pass a magnet 222 and/or an electrical contact 228). In rotary mode, the valves 226 may be activated in the same manner or not at all. In embodiments that use electrically actuated valves 226, one or more power sources, such as an alternator, can be used to provide power for the valves 226 (e.g., due to high frequency actuation of the valves). In further embodiments, power may also be provided from one or more other tools in a drill string 200 (e.g., using, for example, a wired motor). It should be noted that the sensors 214 and 282 described herein are provided by way of example and are not meant to limit the present disclosure. In other embodiments, a sensor 214 and/or 282 can include other instrumentation. For example, a resolver on an electric motor can be used as a sensor. Further, when the bearing housing 204 is rotationally fixed to other elements of a drill string 200 (e.g., rigidly connected to one or more drill pipes), measurements taken elsewhere on the drill string 200 and/or a bottom hole assembly may be passed to, for example, the implement 202 and associated with a rotational characteristic of the bearing housing 204.

Figure 15:
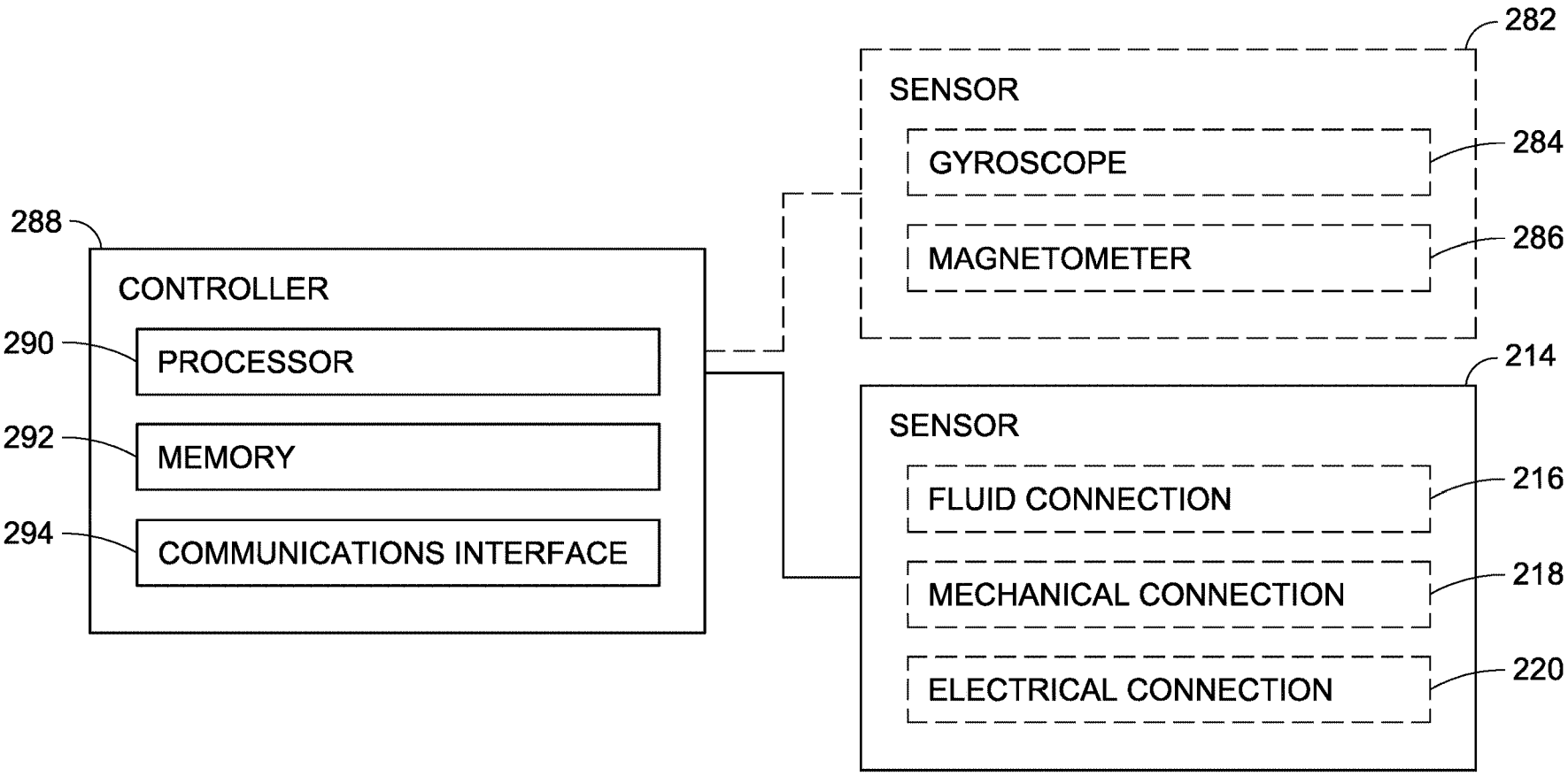
FIG. 15 illustrates various components of an example device that can implement embodiments of Equipment String Communication and Steering.

With reference to FIG. 15, an implement 202, including some or all of its components, can operate under computer control. For example, a processor can be included with or in an implement 202 to control the components and functions of implements 202 described herein using software, firmware, hardware (e.g., fixed logic circuitry), manual processing, or a combination thereof. The terms "controller," "functionality," "service," and "logic" as used herein generally represent software, firmware, hardware, or a combination of software, firmware, or hardware in conjunction with controlling the implements 202. In the case of a software implementation, the module, functionality, or logic represents program code that performs specified tasks when executed on a processor (e.g., central processing unit (CPU) or CPUs). The program code can be stored in one or more computer-readable memory devices (e.g., internal memory and/or one or more tangible media), and so on. The structures, functions, approaches, and techniques described herein can be implemented on a variety of commercial computing platforms having a variety of processors.

The implement 202 can include a controller 288 for controlling the implement 202. The controller 288 can include a processor 290, a memory 292, and a communications interface 294. The processor 290 provides processing functionality for the controller 288 and can include any number of processors, micro-controllers, or other processing systems, and resident or external memory for storing data and other information accessed or generated by the controller 288. The processor 290 can execute one or more software programs that implement techniques described herein. The processor 290 is not limited by the materials from which it is formed or the processing mechanisms employed therein and, as such, can be implemented via semiconductor(s) and/or transistors (e.g., using electronic integrated circuit (IC) components), and so forth.

The memory 292 is an example of tangible, computer-readable storage medium that provides storage functionality to store various data associated with operation of the controller 288, such as software programs and/or code segments, or other data to instruct the processor 290, and possibly other components of the controller 288, to perform the functionality described herein. Thus, the memory 292 can store data, such as a program of instructions for operating the implement 202 (including its components), and so forth. It should be noted that while a single memory 292 is described, a wide variety of types and combinations of memory (e.g., tangible, non-transitory memory) can be employed. The memory 292 can be integral with the processor 290, can include stand-alone memory, or can be a combination of both.

The memory 292 can include, but is not necessarily limited to: removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, and so forth. In implementations, the implement 202 and/or the memory 292 can include removable integrated circuit card (ICC) memory, such as memory provided by a subscriber identity module (SIM) card, a universal subscriber identity module (USIM) card, a universal integrated circuit card (UICC), and so on.

The communications interface 294 is operatively configured to communicate with components of the implement 202. For example, the communications interface 294 can be configured to transmit data for storage in the implement 202, retrieve data from storage in the implement 202, and so forth. The communications interface 294 is also communicatively coupled with the processor 290 to facilitate data transfer between components of the implement 202 and the processor 290 (e.g., for communicating inputs to the processor 290 received from a device communicatively coupled with the controller 288, such as a sensor 214 and/or 282). It should be noted that while the communications interface 294 is described as a component of a controller 288, one or more components of the communications interface 294 can be implemented as external components communicatively coupled to the implement 202 via a wired and/or wireless connection. The controller 288 can also include and/or connect to one or more input/output (I/O) devices (e.g., via the communications interface 294), including, but not necessarily limited to: a display, a mouse, a touchpad, a keyboard, and so on.

The communications interface 294 and/or the processor 290 can be configured to communicate with a variety of different networks, including, but not necessarily limited to: a wide-area cellular telephone network, such as a 3G cellular network, a 4G cellular network, or a global system for mobile communications (GSM) network; a wireless computer communications network, such as a WiFi network (e.g., a wireless local area network (WLAN) operated using IEEE 802.11 network standards); an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example and is not meant to limit the present disclosure. Further, the communications interface 294 can be configured to communicate with a single network or multiple networks across different access points.

Figure 16A:
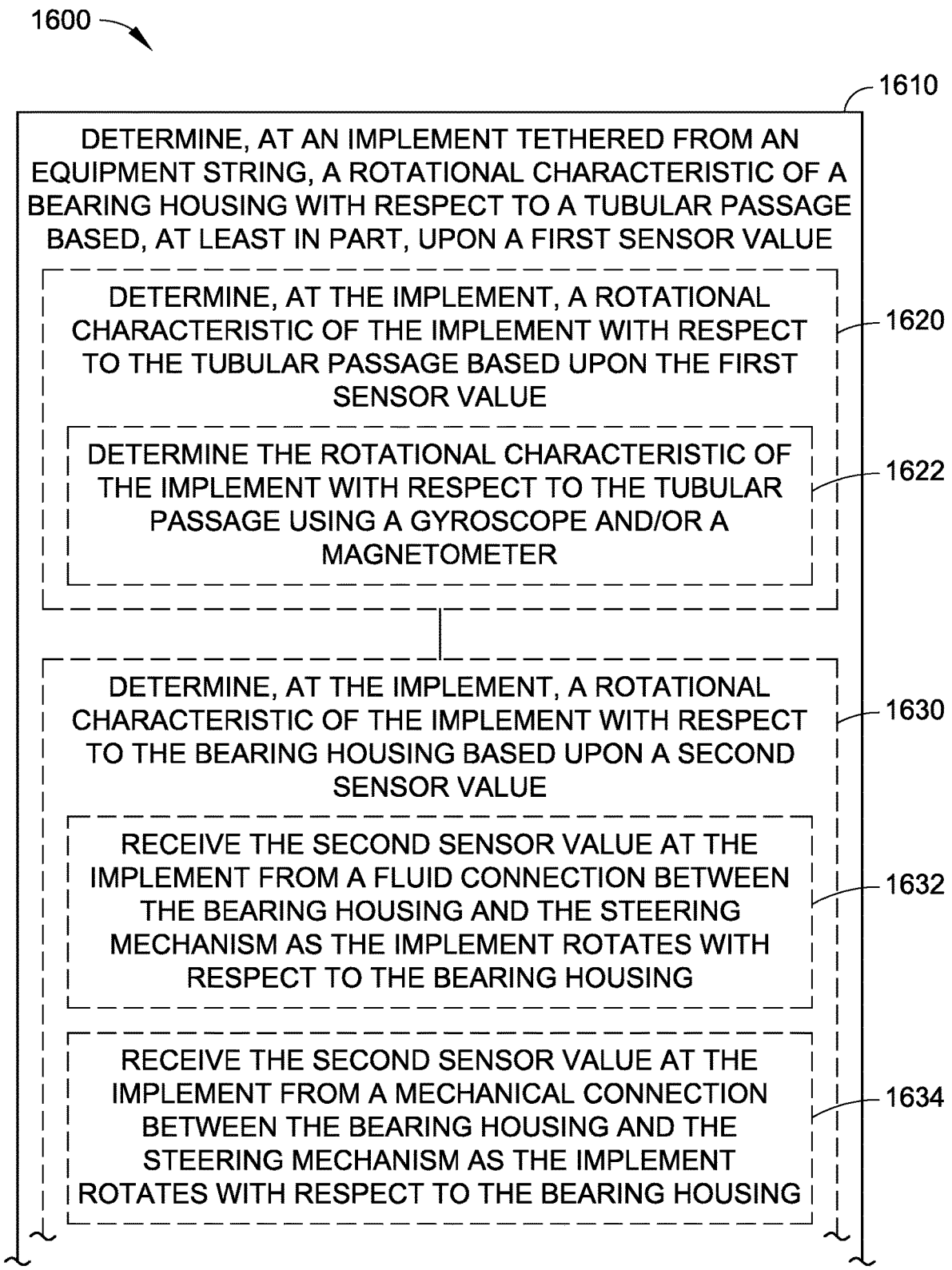
FIG. 16A illustrates example method(s) for Equipment String Communication and Steering in accordance with one or more embodiments.
Figure 16B:
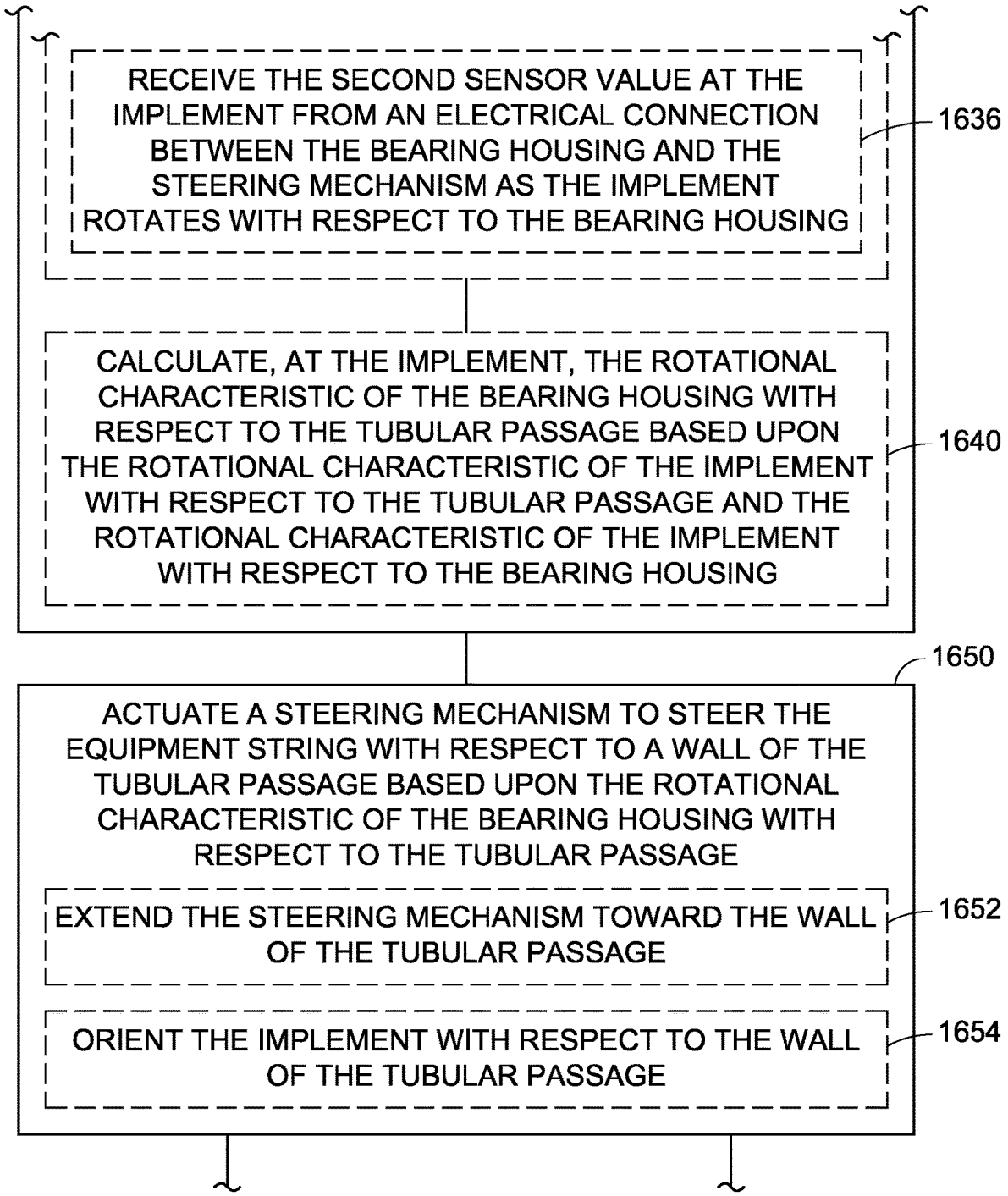
FIG. 16B illustrates example method(s) for Equipment String Communication and Steering in accordance with one or more embodiments.
Figure 16C:
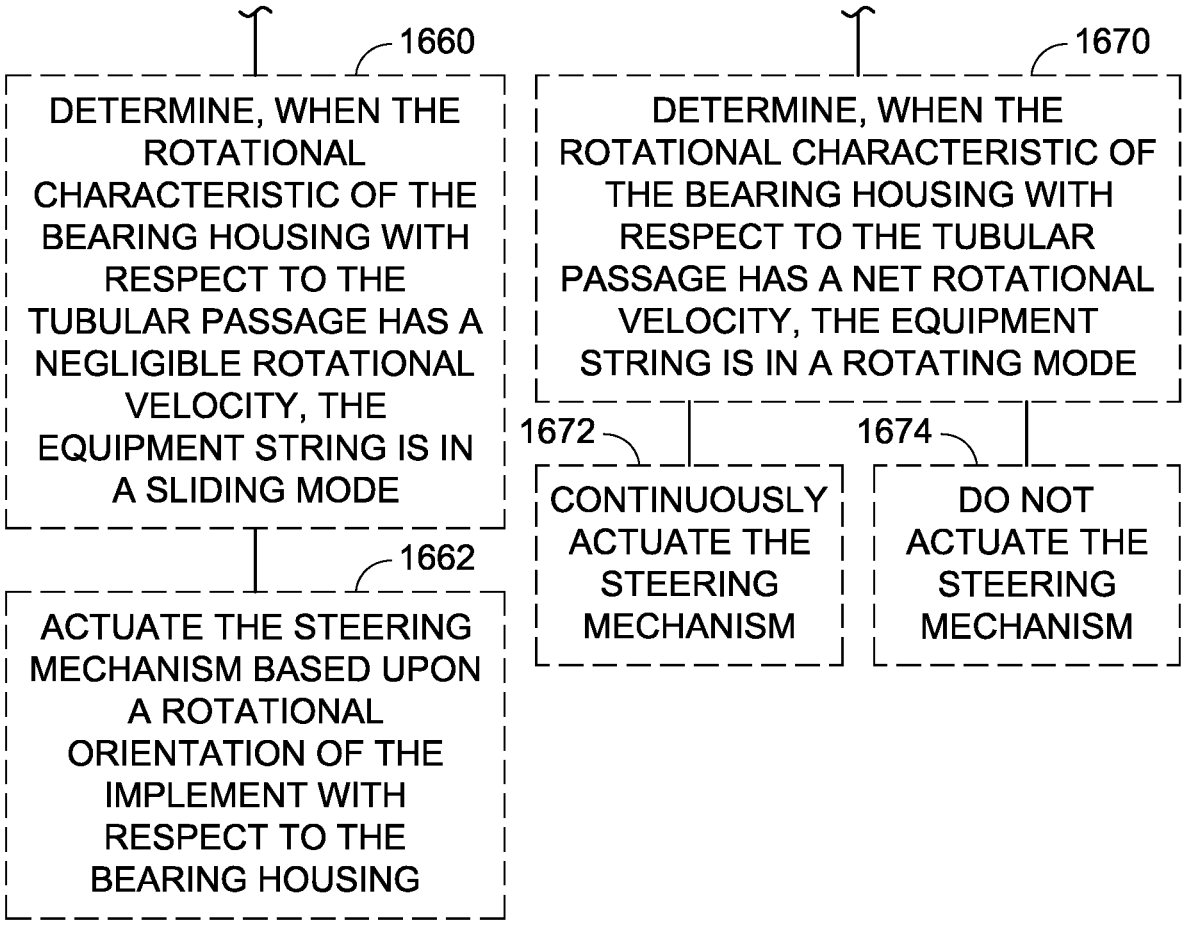
FIG. 16C illustrates example method(s) for Equipment String Communication and Steering in accordance with one or more embodiments.

Referring now to FIG. 16, a procedure 1600 is described in example embodiments in which an implement, such as the implement 202, tethered to an equipment string, such as the drill string 200, is steered. The equipment string traverses a tubular passage, such as the borehole 102. At block 1610, a rotational characteristic of a bearing housing, such as the bearing housing 204, with respect to the tubular passage, such as an RPM measurement of the bearing housing 204 with respect to the borehole 102, is determined at the implement based, at least in part, upon a first sensor value, such as a measurement from the sensor 214 or a measurement from the sensor 282. In embodiments of the disclosure, the first sensor value can be the rotational speed and/or angle of the bearing housing 204 with respect to the borehole 102, the rotational speed and/or angle of the implement 202 with respect to the borehole 102, and so forth.

In some embodiments, at block 1620, a rotational characteristic of the implement with respect to the tubular passage, such as the rotational speed and/or angle of the implement 202 with respect to the borehole 102, is determined at the implement based upon the first sensor value. In some embodiments, at block 1622, the rotational characteristic of the implement with respect to the tubular passage is determined using a gyroscope and/or a magnetometer, such as the gyroscope 284 and/or the magnetometer 286. In some embodiments, at block 1630, a rotational characteristic of the implement with respect to the bearing housing, such as the rotational speed and/or angle of the implement 202 with respect to the bearing housing 204, is determined at the implement based upon a second sensor value, such as a measurement from the sensor 214.

In some embodiments, at block 1632, the second sensor value is received at the implement from a fluid connection, such as the fluid connection 216, between the bearing housing and the steering mechanism as the implement rotates with respect to the bearing housing. In some embodiments, at block 1634, the second sensor value is received at the implement from a mechanical connection, such as the mechanical connection 218, between the bearing housing and the steering mechanism as the implement rotates with respect to the bearing housing. In some embodiments, at block 1636, the second sensor value is received at the implement from an electrical connection, such as the electrical connection 220, between the bearing housing and the steering mechanism as the implement rotates with respect to the bearing housing.

In some embodiments, at block 1640, the rotational characteristic of the bearing housing with respect to the tubular passage is calculated at the implement based upon the rotational characteristic of the implement with respect to the tubular passage and the rotational characteristic of the implement with respect to the bearing housing. For example, the processor 290 calculates the rotational characteristic of the bearing housing 204 with respect to the borehole 102 based upon the rotational characteristic of the implement 202 with respect to the borehole 102 and the rotational characteristic of the implement 202 with respect to the bearing housing 204.

At block 1650, a steering mechanism, such as the steering mechanism 208, is actuated to steer the equipment string with respect to a wall of the tubular passage, such as wall of the borehole 102, based upon the rotational characteristic of the bearing housing with respect to the tubular passage. In some embodiments, at block 1652, the steering mechanism is extended toward the wall of the tubular passage. For instance, the pad 210 is extended toward the wall of the borehole 102. In some embodiments, at block 1654, the implement is oriented with respect to the wall of the tubular passage. For example, the implement 202 is oriented with respect to the wall of the borehole 102 by pointing a sleeve using one or more pistons, cams, and/or other devices to control the angle of the implement 202 with respect to the drill string 200.

In some embodiments, at block 1660, a determination is made that the equipment string is in a sliding mode when the rotational characteristic of the bearing housing with respect to the tubular passage has a negligible rotational velocity. In some embodiments, at block 1662, when a determination is made that the equipment string is in the sliding mode, the steering mechanism is actuated based upon a rotational orientation of the implement with respect to the bearing housing. For instance, when the drill string 200 is in a sliding mode, the steering mechanism 208 is actuated based upon a rotational orientation of the implement 202 with respect to the bearing housing 204. In some embodiments, the steering mechanism 208 is actuated when the drill string 200 is in the sliding mode.

In some embodiments, at block 1670, a determination is made that the equipment string is in a rotating mode when the rotational characteristic of the bearing housing with respect to the tubular passage has a net rotational velocity. In some embodiments, at block 1672, when a determination is made that the equipment string is in the rotating mode, the steering mechanism is continuously actuated. For example, when the drill string 200 is in the rotating mode, the steering mechanism 208 is continuously actuated. In some embodiments, at block 1674, when a determination is made that the equipment string is in the rotating mode, the steering mechanism is not actuated. For instance, when the drill string 200 is in the rotating mode, the steering mechanism 208 is not actuated. As previously described, in some embodiments the steering mechanism 208 is actuated when the drill string 200 is in the sliding mode.

Figure 17A:
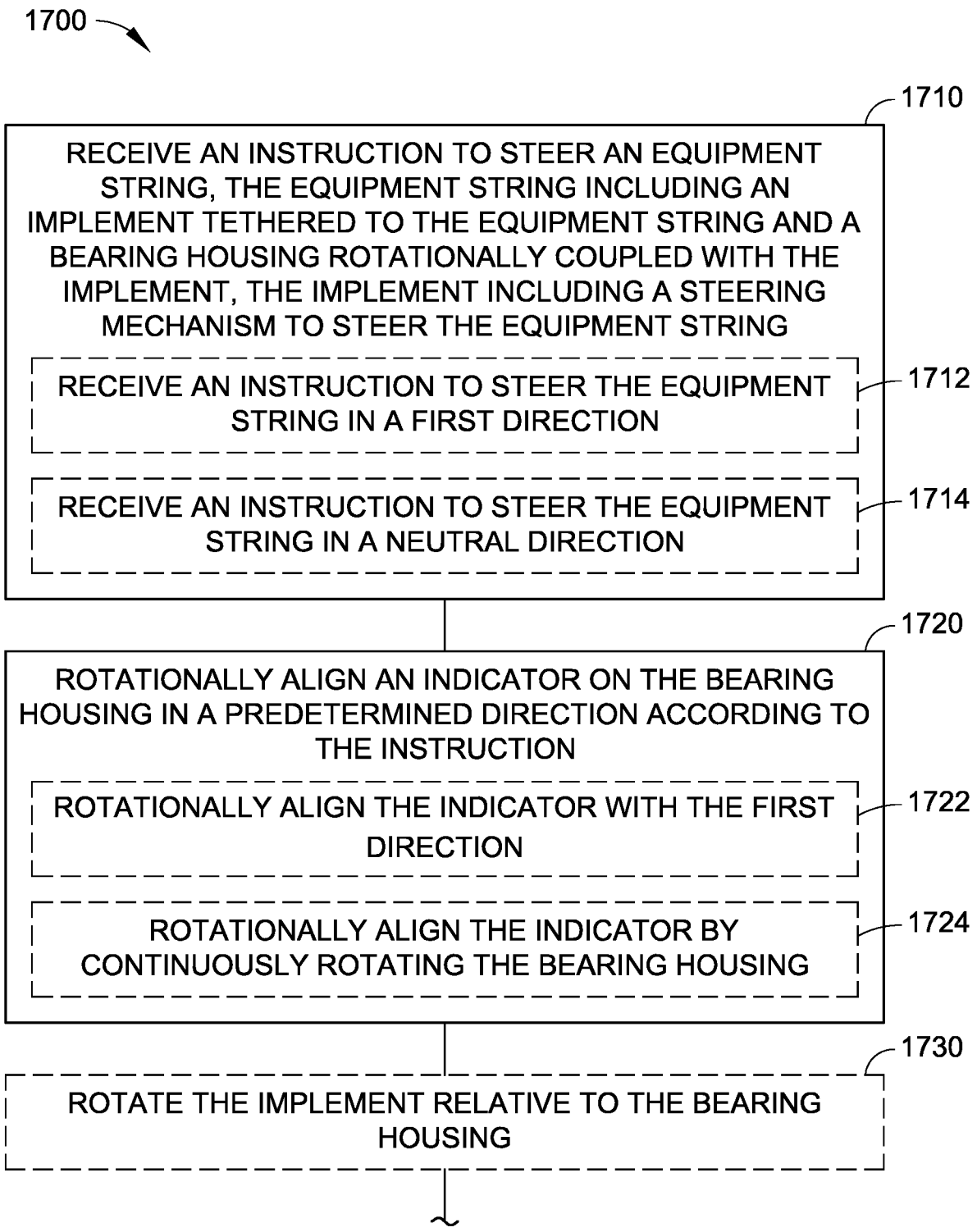
FIG. 17A illustrates example method(s) for Equipment String Communication and Steering in accordance with one or more embodiments.
Figure 17B:
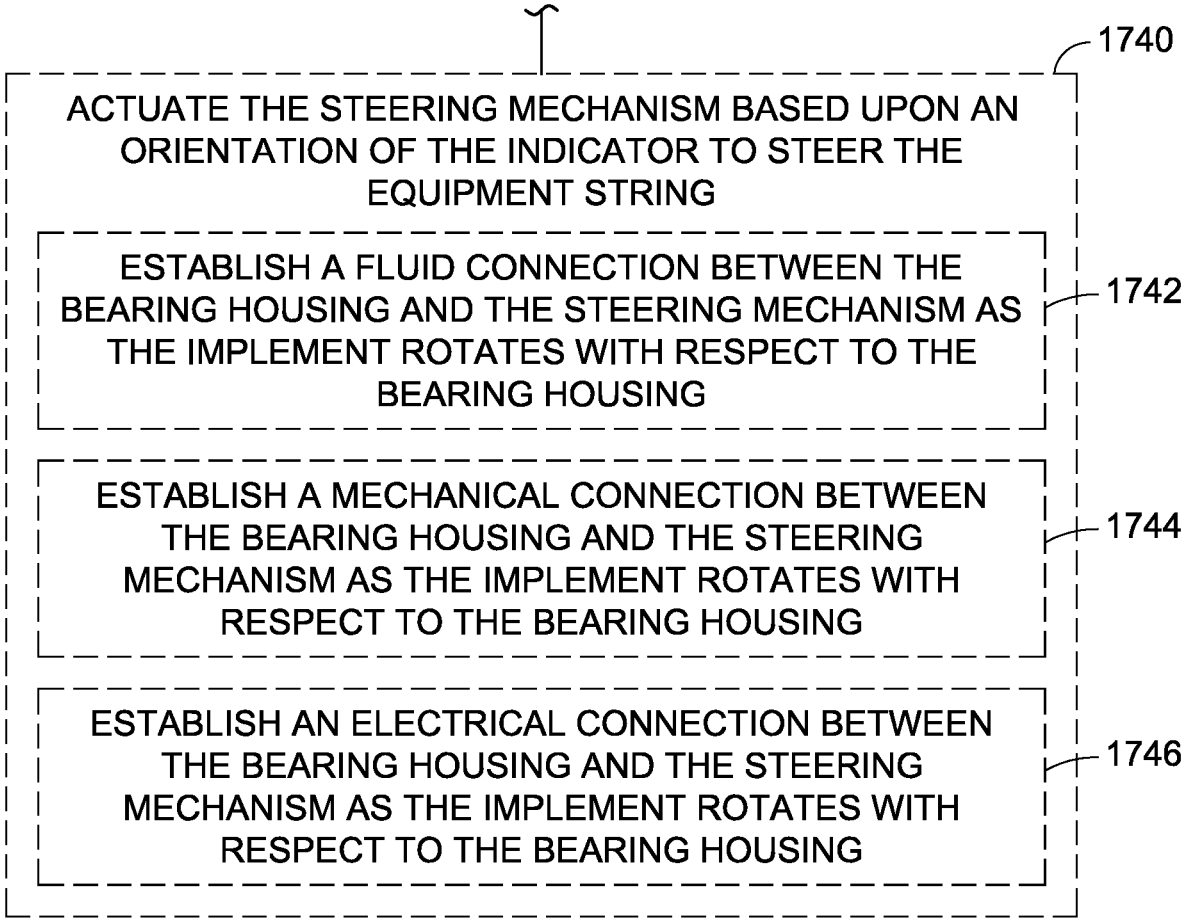
FIG. 17B illustrates example method(s) for Equipment String Communication and Steering in accordance with one or more embodiments.

Referring now to FIG. 17, a procedure 1700 is described in example embodiments in which directional drilling is performed. At block 1710, an instruction is received to steer an equipment string, such as the drill string 200. The equipment string traverses a tubular passage, such as the borehole 102. The equipment string includes an implement tethered to the equipment string, such as the implement 202, and a bearing housing rotationally coupled with the implement to support the implement and to be rotated, such as the bearing housing 204. The implement includes a steering mechanism to steer the equipment string, such as the steering mechanism 208. In some embodiments, at block 1712, the instruction received is to steer the equipment string in a first direction, such as a specific direction (e.g., Northwest) with respect to a wall of the borehole 102. In some embodiments, at block 1714, the instruction received is to steer the equipment string in a neutral direction, such as in no particular direction with respect to the wall of the borehole 102.

At block 1720, an indicator on the bearing housing, such as the magnet 222 and/or the electrical contact 228, is rotationally aligned in a predetermined direction according to the instruction, such as a specific direction (e.g., Northwest) with respect to a wall of the borehole 102. In some embodiments, at block 1722, the indicator is rotationally aligned with the first direction (e.g., according to the instruction received at block 1712). In some embodiments, at block 1724, the indicator is rotationally aligned by continuously rotating the bearing housing (e.g., according to the instruction received at block 1714).

In some embodiments, at block 1730, the implement is rotated relative to the bearing housing. For example, the implement 202 is rotated relative to the bearing housing 204. In some embodiments, at block 1740, the steering mechanism is actuated based upon an orientation of the indicator to steer the equipment string with respect to a wall of the tubular passage, such as the wall of the borehole 102. In some embodiments, at block 1742, a fluid connection, such as the fluid connection 216, is established between the bearing housing and the steering mechanism as the implement rotates with respect to the bearing housing. In some embodiments, at block 1744, a mechanical connection, such as the mechanical connection 218, is established between the bearing housing and the steering mechanism as the implement rotates with respect to the bearing housing. In some embodiments, at block 1746, an electrical connection, such as the electrical connection 220, is established between the bearing housing and the steering mechanism as the implement rotates with respect to the bearing housing.

Generally, any of the functions described herein can be implemented using hardware (e.g., fixed logic circuitry such as integrated circuits), software, firmware, manual processing, or a combination thereof. Thus, the blocks discussed in the above disclosure generally represent hardware (e.g., fixed logic circuitry such as integrated circuits), software, firmware, or a combination thereof. In the instance of a hardware configuration, the various blocks discussed in the above disclosure may be implemented as integrated circuits along with other functionality. Such integrated circuits may include all of the functions of a given block, system, or circuit, or a portion of the functions of the block, system, or circuit. Further, elements of the blocks, systems, or circuits may be implemented across multiple integrated circuits. Such integrated circuits may include various integrated circuits, including, but not necessarily limited to: a monolithic integrated circuit, a flip chip integrated circuit, a multichip module integrated circuit, and/or a mixed signal integrated circuit. In the instance of a software implementation, the various blocks discussed in the above disclosure represent executable instructions (e.g., program code) that perform specified tasks when executed on a processor. These executable instructions can be stored in one or more tangible computer readable media. In some such instances, the entire system, block, or circuit may be implemented using its software or firmware equivalent. In other instances, one part of a given system, block, or circuit may be implemented in software or firmware, while other parts are implemented in hardware.

Although only a few example embodiments have been described in detail above, those skilled in the art will readily appreciate that many modifications are possible in the example embodiments without materially departing from Equipment String Communication and Steering as described herein. Additionally, it should be understood that references to "one embodiment" or "an embodiment" of the present disclosure are not intended to be interpreted as excluding the existence of additional embodiments that also incorporate the recited features. For example, features shown in individual embodiments referred to above may be used together in combinations other than those which have been shown and described specifically. Accordingly, any such modification is intended to be included within the scope of this disclosure. In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function for any limitations of any of the claims herein, except for those in which the claim expressly uses the words 'means for' together with an associated function.

What is claimed is:

1. A method of performing directional drilling, the method comprising:

receiving an instruction to steer an equipment string, the equipment string to traverse a tubular passage, the equipment string including an implement tethered to the equipment string and a bearing housing rotationally coupled with the implement to support the implement and to be rotated, the implement including a steering mechanism to steer the equipment string;

rotationally aligning an indicator on the bearing housing in a direction according to the instruction;

rotating the implement relative to the bearing housing; and actuating the steering mechanism based upon an orientation of the indicator to steer the equipment string with respect to a wall of the tubular passage.

2. The method as recited in claim 1, wherein receiving the instruction to steer the equipment string comprises receiving an instruction to steer the equipment string in a first direction.

3. The method as recited in claim 2, further comprising rotationally aligning the indicator with the first direction.

4. The method as recited in claim 1, wherein receiving the instruction to steer the equipment string comprises receiving an instruction to steer the equipment string in a neutral direction.

5. The method as recited in claim 4, further comprising rotationally aligning the indicator by continuously rotating the bearing housing.

6. The method as recited in claim 1, wherein actuating the steering mechanism comprises establishing a fluid connection between the bearing housing and the steering mechanism as the implement rotates with respect to the bearing housing.

7. The method as recited in claim 1, wherein actuating the steering mechanism comprises establishing a mechanical connection between the bearing housing and the steering mechanism as the implement rotates with respect to the bearing housing.

8. The method as recited in claim 1, wherein actuating the steering mechanism comprises establishing an electrical connection between the bearing housing and the steering mechanism as the implement rotates with respect to the bearing housing.

9. A method of performing directional drilling, the method comprising:

receiving an instruction to steer an equipment string, the equipment string to traverse a tubular passage, the equipment string including an implement tethered to the equipment string and a bearing housing rotationally coupled with the implement to support the implement and to be rotated, the implement including a steering mechanism to steer the equipment string; and rotationally aligning an indicator on the bearing housing in a set direction according to the instruction.

10. The method as recited in claim 9, wherein receiving the instruction to steer the equipment string comprises receiving an instruction to steer the equipment string in a first direction.

11. The method as recited in claim 10, further comprising rotationally aligning the indicator with the first direction.

12. The method as recited in claim 9, wherein receiving the instruction to steer the equipment string comprises receiving an instruction to steer the equipment string in a neutral direction.

13. The method as recited in claim 12, further comprising rotationally aligning the indicator by continuously rotating the bearing housing.

14. The method as recited in claim 9, further comprising actuating the steering mechanism based upon an orientation of the indicator to steer the equipment string with respect to a wall of the tubular passage.

15. The method as recited in claim 14, wherein actuating the steering mechanism comprises establishing a fluid connection between the bearing housing and the steering mechanism as the implement rotates with respect to the bearing housing.

16. The method as recited in claim 14, wherein actuating the steering mechanism comprises establishing a mechanical connection between the bearing housing and the steering mechanism as the implement rotates with respect to the bearing housing.

17. The method as recited in claim 14, wherein actuating the steering mechanism comprises establishing an electrical connection between the bearing housing and the steering mechanism as the implement rotates with respect to the bearing housing.

18. A method of performing directional drilling, the method comprising:

receiving an instruction to steer an equipment string, the equipment string to traverse a tubular passage, the equipment string including an implement tethered to the equipment string and a bearing housing rotationally coupled with the implement to support the implement and to be rotated, the implement including a steering mechanism to steer the equipment string;

rotationally aligning an indicator on the bearing housing in a set direction according to the instruction; and actuating the steering mechanism based upon an orientation of the indicator to steer the equipment string with respect to a wall of the tubular passage, wherein the instruction to steer the equipment string comprises an instruction to steer the equipment string in a neutral direction, and the indicator is rotationally aligned by continuously rotating the bearing housing.

19. The method as recited in claim 18, wherein actuating the steering mechanism comprises establishing a fluid connection between the bearing housing and the steering mechanism as the implement rotates with respect to the bearing housing.

20. The method as recited in claim 18, wherein actuating the steering mechanism comprises establishing a mechanical connection between the bearing housing and the steering mechanism as the implement rotates with respect to the bearing housing.

* * * * *